US011338574B2

(12) United States Patent
Kuramoto et al.

(10) Patent No.: US 11,338,574 B2
(45) Date of Patent: May 24, 2022

(54) LIQUID EJECTING APPARATUS AND METHOD FOR CONTROLLING LIQUID EJECTING APPARATUS

(71) Applicant: SEIKO EPSON CORPORATION, Tokyo (JP)

(72) Inventors: Yasunori Kuramoto, Ebina (JP); Yukimasa Ishida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/003,319

(22) Filed: Aug. 26, 2020

(65) Prior Publication Data

US 2021/0060928 A1 Mar. 4, 2021

(30) Foreign Application Priority Data

Aug. 30, 2019 (JP) ..... JP2019-158637

(51) Int. Cl.
*B41J 2/045* (2006.01)

(52) U.S. Cl.
CPC ..... *B41J 2/0451* (2013.01); *B41J 2/04571* (2013.01); *B41J 2/04581* (2013.01); *B41J 2/04588* (2013.01)

(58) Field of Classification Search
CPC ..... B41J 2/0451; B41J 2/04571; B41J 2002/14354; B41J 2002/14362; B41J 2002/14419; B41J 2/04581; B41J 2/04588; B41J 2/16579; B41J 2/04541; B41J 2/04563; B41J 2/04596; B41J 2/14233
See application file for complete search history.

(56) References Cited

U.S. PATENT DOCUMENTS

| | | | | |
|---|---|---|---|---|
| 2004/0252151 | A1 | 12/2004 | Higuchi et al. | |
| 2011/0115841 | A1* | 5/2011 | Ito | B41J 2/04563 347/14 |
| 2013/0293610 | A1 | 11/2013 | Suzuki et al. | |
| 2016/0207340 | A1 | 7/2016 | Takano et al. | |
| 2017/0225455 | A1* | 8/2017 | Veenstra | B41J 2/0451 |
| 2019/0084300 | A1* | 3/2019 | Machida | B41J 2/175 |
| 2019/0299589 | A1* | 10/2019 | Kiuchi | B41J 2/04586 |

FOREIGN PATENT DOCUMENTS

| | | |
|---|---|---|
| JP | 2006-312328 | 11/2006 |
| JP | 2013-233656 | 11/2013 |
| JP | 2014-177058 | 9/2014 |
| JP | 2016-036994 | 3/2016 |
| JP | 2016-135585 | 7/2016 |
| JP | 2017-148957 | 8/2017 |

* cited by examiner

*Primary Examiner* — Scott A Richmond
(74) *Attorney, Agent, or Firm* — Workman Nydegger

(57) ABSTRACT

A liquid ejecting apparatus includes a first pressure chamber communicating with a first nozzle configured to eject a liquid, a second pressure chamber adjacent to the first pressure chamber and communicating with a second nozzle configured to eject the liquid, and a first driving element corresponding to the first pressure chamber. The liquid ejecting apparatus executes a detection operation of detecting a fluctuation in the pressure of the liquid within the second pressure chamber that occurred when the first driving element was driven to cause the pressure of the liquid within the first pressure chamber to fluctuate.

17 Claims, 15 Drawing Sheets

LIQUID EJECTING APPARATUS AND METHOD FOR CONTROLLING LIQUID EJECTING APPARATUS

The present application is based on, and claims priority from JP Application Serial Number 2019-158637, filed Aug. 30, 2019, the disclosure of which is hereby incorporated by reference herein in its entirety.

BACKGROUND

1. Technical Field

The present disclosure relates to a technique for ejecting a liquid such as ink.

2. Related Art

A liquid ejecting apparatus for ejecting a liquid such as ink onto a medium such as a printing sheet may not appropriately eject ink due to an abnormality caused by aging degradation or the like. JP-A-2006-312328 discloses a configuration for detecting abnormal ejection in which ink is not normally ejected. Abnormal ejection of a nozzle is detected based on a vibration pattern of residual vibrations of a vibrating plate that occurred when an actuator was driven to the extent that ink was not ejected from the nozzle.

The technique disclosed in JP-A-2006-312328 is to detect abnormal ejection caused by mixing of air bubbles in a pressure chamber, dry of ink within a nozzle, or the like. It is, however, difficult for the technique disclosed in JP-A-2006-312328 to detect a structural defect of a pressure chamber of a liquid ejecting apparatus.

SUMMARY

According to an aspect of the disclosure, a liquid ejecting apparatus includes a first pressure chamber communicating with a first nozzle for ejecting a liquid, a second pressure chamber adjacent to the first pressure chamber and communicating with a second nozzle for ejecting the liquid, and a first driving element corresponding to the first pressure chamber. The liquid ejecting apparatus executes a detection operation of detecting a fluctuation in the pressure of the liquid within the second pressure chamber that occurred when the first driving element was driven to cause the pressure of the liquid within the first pressure chamber to fluctuate.

According to another aspect of the disclosure, a method for controlling a liquid ejecting apparatus including a first pressure chamber communicating with a first nozzle for ejecting a liquid, a second pressure chamber adjacent to the first pressure chamber and communicating with a second nozzle for ejecting the liquid, and a first driving element corresponding to the first pressure chamber includes executing a detection operation of detecting a fluctuation in the pressure of the liquid within the second pressure chamber that occurred when the first driving element was driven to cause the pressure of the liquid within the first pressure chamber to fluctuate.

DESCRIPTION OF EXEMPLARY EMBODIMENTS

A. First Embodiment

Figure 1:
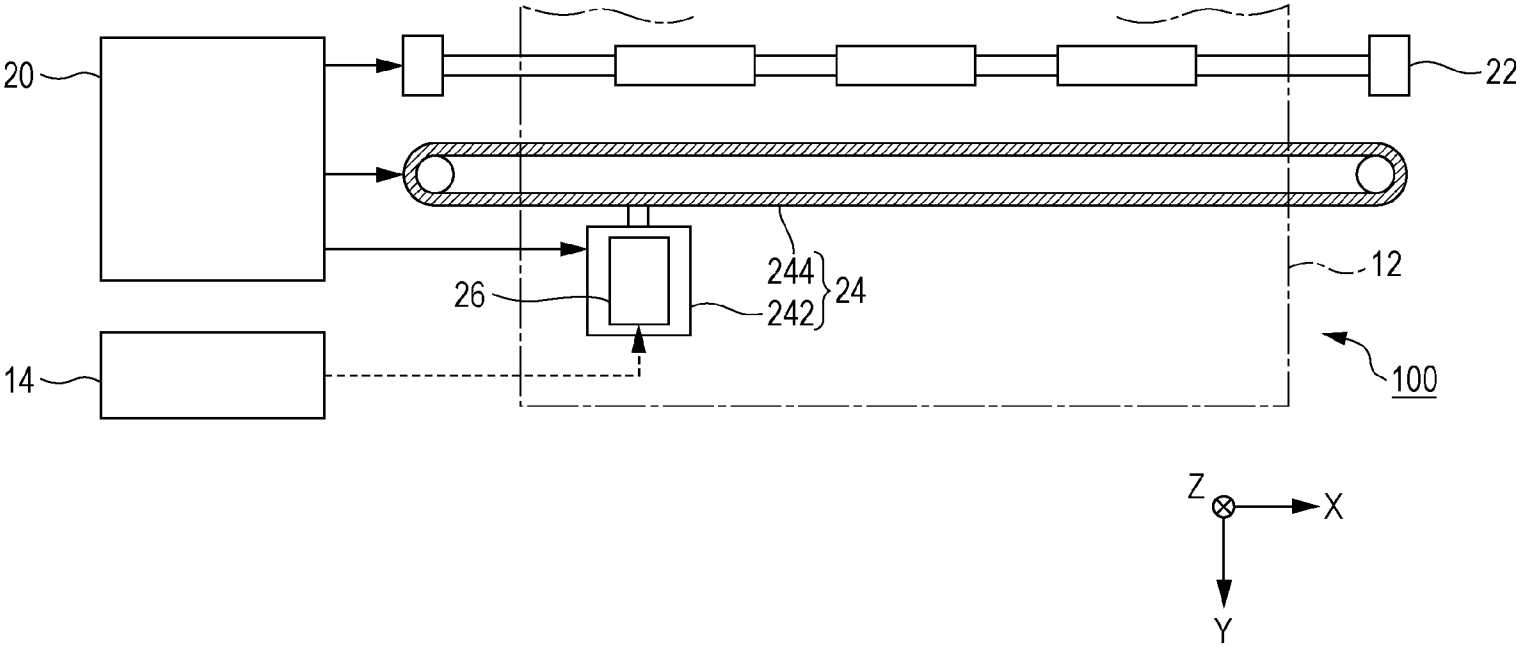
FIG. 1 is a configuration diagram of a liquid ejecting apparatus according to a first embodiment.

FIG. 1 is a configuration diagram exemplifying a configuration of a liquid ejecting apparatus 100 according to a first embodiment. The liquid ejecting apparatus 100 according to the first embodiment is an ink jet printing apparatus for ejecting ink onto a medium 12. The ink is an example of a liquid. Although the medium 12 is typically a printing sheet, a printing object made of an arbitrary material such as a resin film or cloth is used as the medium 12. As exemplified in FIG. 1, a liquid container 14 for storing the ink is installed in the liquid ejecting apparatus 100. For example, a cartridge attachable to and detachable from the liquid ejecting apparatus 100, a bag-shaped ink pack made of a flexible film, or an ink tank that can be refilled with ink is used as the liquid container 14.

As exemplified in FIG. 1, the liquid ejecting apparatus 100 includes a control unit 20, a transporting mechanism 22, a moving mechanism 24, and a liquid ejecting head 26. The control unit 20 includes, for example, a processing circuit such as a central processing unit (CPU) or a field programmable gate array (FPGA) and a storage circuit such as a semiconductor memory. The control unit 20 comprehensively controls the elements of the liquid ejecting apparatus 100. The transporting mechanism 22 transports the medium 12 in a Y-axis direction under control by the control unit 20.

The moving mechanism 24 causes the liquid ejecting head 26 to reciprocate in an X-axis direction under control by the control unit 20. The X-axis direction intersects the Y-axis direction. Typically, the X-axis direction is perpendicular to the Y-axis direction. The moving mechanism 24 according to the first embodiment includes a substantially box-shaped transport body 242 storing the liquid ejecting head 26, and a transport belt 244 to which the transport body 242 is fixed. A configuration in which a plurality of liquid ejecting heads 26 are installed in the transport body 242 or a configuration in which the liquid container 14 and the liquid ejecting head 26 are installed in the transport body 242 may be used.

The liquid ejecting head 26 ejects the ink supplied from the liquid container 14 onto the medium 12 from a plurality of nozzles under control by the control unit 20. The liquid ejecting head 26 ejects the ink onto the medium 12 in parallel with the transportation of the medium 12 by the transporting mechanism 22 and the repetitive reciprocation of the transport body 242 so that a desired image is formed on a surface of the medium 12.

Figure 2:
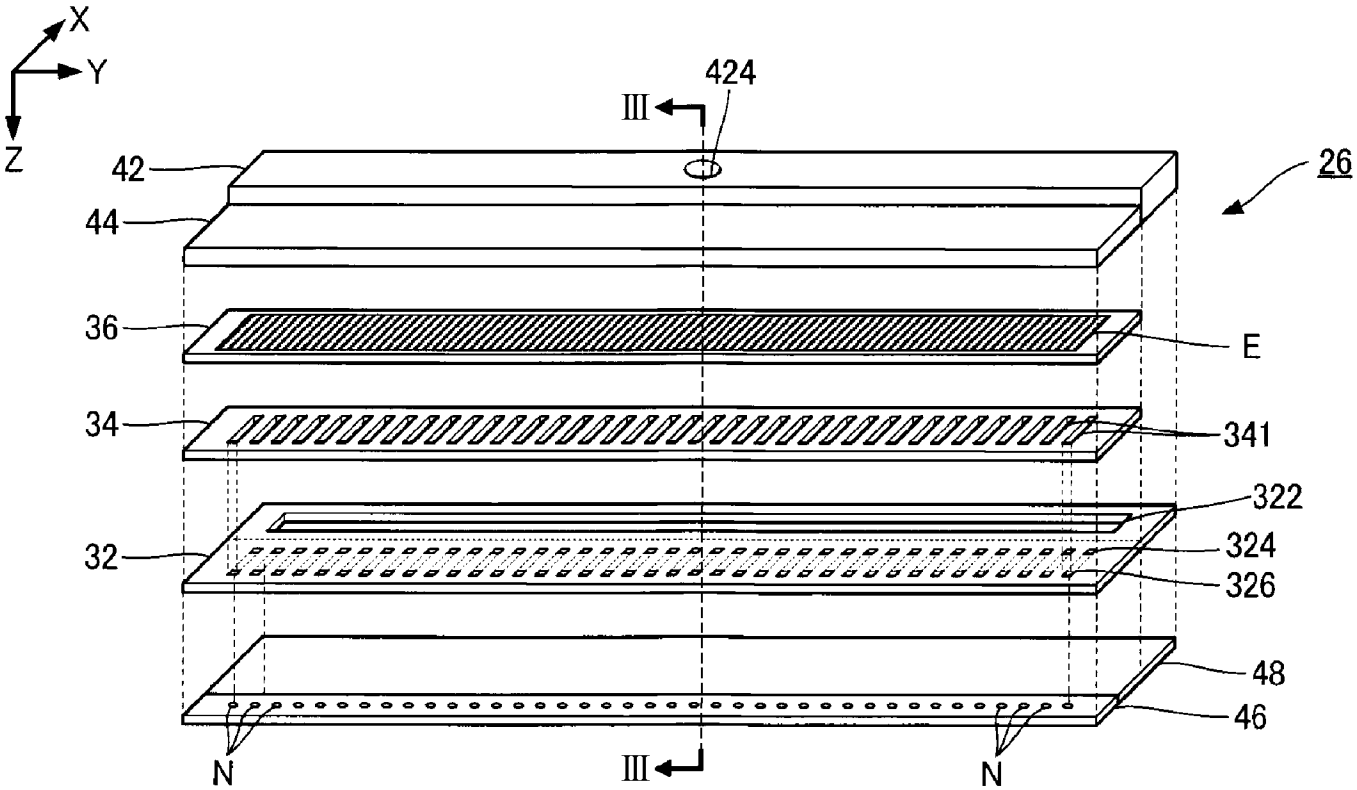
FIG. 2 is an exploded perspective view of a liquid ejecting head.
Figure 3:
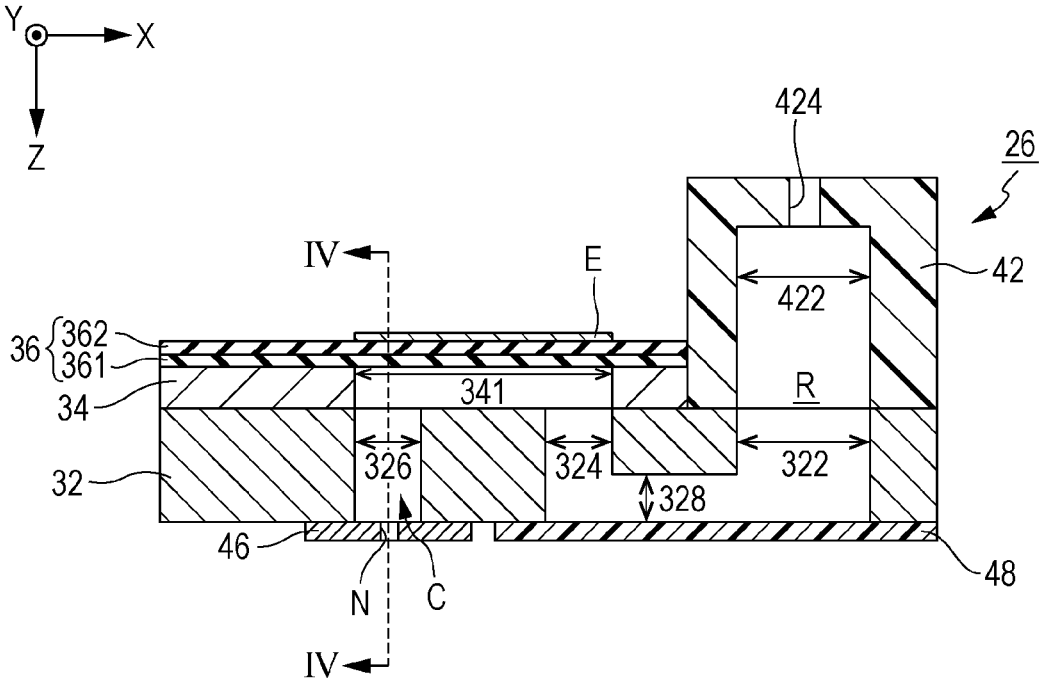
FIG. 3 is a cross-sectional view of the liquid ejecting head.

FIG. 2 is an exploded perspective view of the liquid ejecting head 26. FIG. 3 is a cross-sectional view taken along a line III-III illustrated in FIG. 2. As exemplified in FIG. 2, an axis direction perpendicular to an X-Y plane is referred to as Z-axis direction. The liquid ejecting head 26 ejects the ink in the Z-axis direction. The X-Y plane is parallel to, for example, the surface of the medium 12.

As exemplified in FIGS. 2 and 3, the liquid ejecting head 26 includes a first channel substrate 32, a second channel substrate 34, a vibrating plate 36, a plurality of driving elements E, a nozzle plate 46, and a flexible member 48. The first channel substrate 32 is a substantially rectangular plate-shaped member formed in a long shape extending in the Y-axis direction. The second channel substrate 34, the vibrating plate 36, the plurality of driving elements E, and a casing 42 are mounted on a surface of the first channel substrate 32 on a negative side in the Z-axis direction. The nozzle plate 46 and the flexible member 48 are mounted on another surface of the first channel substrate 32 on a positive side in the Z-axis direction. The elements of the liquid ejecting head 26 are substantially plate-shaped members formed in long shapes extending in the Y-axis direction, similarly to the first channel substrate 32. For example, the elements of the liquid ejecting head 26 are bonded to each other via, for example, an adhesive.

As exemplified in FIG. 2, the nozzle plate 46 is a plate-shaped member in which the plurality of nozzles N are formed and arrayed in the Y-axis direction. The nozzles N are through-holes through which the ink passes. The first channel substrate 32, the second channel substrate 34, and the nozzle plate 46 are formed by, for example, processing a silicon (Si) monocrystalline substrate using a semiconductor manufacturing technique such as etching. However, materials of the elements of the liquid ejecting head 26 and a method for manufacturing the elements of the liquid ejecting head 26 are arbitrary.

The first channel substrate 32 is a plate-shaped member in which ink channels are formed. As exemplified in FIGS. 2 and 3, an opening 322, supply channels 324, and communication channels 326 are formed in the first channel substrate 32. The opening 322 is a through-hole that is continuous across the plurality of nozzles N and formed in a long shape extending in the Y-axis direction in a plan view from the Z-axis direction. The supply channels 324 and the communication channels 326 are through-holes. Each of the supply channels 324 is formed for a respective one of the nozzles N, while each of the communication channels 326 is formed for a respective one of the nozzles N. The communication channels 326 cause the nozzles N to communicate with pressurization channels 341. As exemplified in FIG. 3, a relay channel 328 extending across the plurality of supply channels 324 is formed on the surface of the first channel substrate 32 on the positive side in the Z-axis direction. The relay channel 328 causes the opening 322 to communicate with the plurality of supply channels 324.

The casing 42 is, for example, a structural body formed by performing injection molding on a resin material. The casing 42 is fixed to the surface of the first channel substrate 32 on the negative side in the Z-axis direction. As exemplified in FIG. 3, a storage section 422 and an inlet 424 are formed in the casing 42. The storage section 422 is a recess having an outer shape corresponding to the opening 322 of the first channel substrate 32. The inlet 424 is a through-hole communicating with the storage section 422. As understood from FIG. 3, a space in which the opening 322 of the first channel substrate 32 and the storage section 422 of the casing 42 communicate with each other functions as a common liquid reservoir R. The ink is supplied from the liquid container 14, passes through the inlet 424, and is stored in the common liquid reservoir R.

The flexible member 48 is an element for reducing a fluctuation in the pressure of the ink within the common liquid reservoir R. For example, the flexible member 48 includes a flexible sheet member that is elastically deformable. The flexible member 48 is a so-called compliance substrate. Specifically, the flexible member 48 is formed on the surface of the first channel substrate 32 on the positive side in the Z-axis direction so that a bottom surface of the common liquid reservoir R is configured by closing the opening 322 of the first channel substrate 32, the relay channel 328, and the plurality of supply channels 324.

As exemplified in FIGS. 2 and 3, the second channel substrate 34 is a plate-shaped member in which the plurality of pressurization channels 341 corresponding to the different nozzles N are formed. The plurality of pressurization channels 341 are arrayed in the Y-axis direction. The pressurization channels 341 are openings, each of which is formed in a long shape extending in the X-axis direction in a plan view. Each of ends of the pressurization channels 341 on a positive side in the X-axis direction overlaps a respective one of the supply channels 324 of the first channel substrate 32 in a plan view, while each of other ends of the pressurization channels 341 on a negative side in the X-axis direction overlaps a respective one of the communication channels 326 of the first channel substrate 32 in the plan view.

The vibrating plate 36 is mounted on a surface of the second channel substrate 34 on the opposite side to the first channel substrate 32. The vibrating plate 36 is a plate-shaped member that is elastically deformable. As exemplified in FIG. 2, the vibrating plate 36 is, for example, formed by stacking a first layer 361 made of a silicon oxide ($SiO_2$) and a second layer 362 made of a zirconium oxide ($ZrO_2$). The second channel substrate 34 and the first layer 361 of the vibrating plate 36 may be integrated with each other by partially removing regions corresponding to the pressurization channels 341 from the plate-shaped member.

As understood from FIG. 3, the first channel substrate 32 and the vibrating plate 36 are arranged opposite to each other at a distance on the inner side of the pressurization channels 341. The pressurization channels 341 are spaces located between the first channel substrate 32 and the vibrating plate 36 and configured to apply pressure to the ink stored in the pressurization channels 341. The ink stored in the common liquid reservoir R is supplied from the relay channel 328 through the plurality of supply channels 324 to the pressurization channels 341 in parallel so that the ink is filled in the pressurization channels 341. The pressurization channels 341 communicate with the nozzles N via the first channel substrate 32. Portions of the vibrating plate 36 constitute upper surfaces of the pressurization channels 341. The pressurization channels 341 and the communication channels 326 correspond to pressure chambers C communicating with the nozzles N. The plurality of pressurization channels C are arrayed in the Y-axis direction.

As exemplified in FIGS. 2 and 3, the plurality of driving elements E corresponding to the different nozzles N are mounted on a surface of the vibrating plate 36 on the opposite side to the pressurization channels 341. The driving elements E cause the pressure of the ink within the pressure chambers C to fluctuate. For example, piezoelectric elements that are deformed based on a driving signal COM supplied from the control unit 20 are used as the driving elements E. Each of the driving elements E is formed in a long shape extending in the X-axis direction in a plan view from the Z-axis direction. The plurality of driving elements E are arrayed in the Y-axis direction so that the plurality of driving elements E correspond to the plurality of pressurization channels 341. When the vibrating plate 36 vibrates in coordination with the deformation of the driving elements E, the pressure within the pressure chambers C fluctuates.

Figure 4:
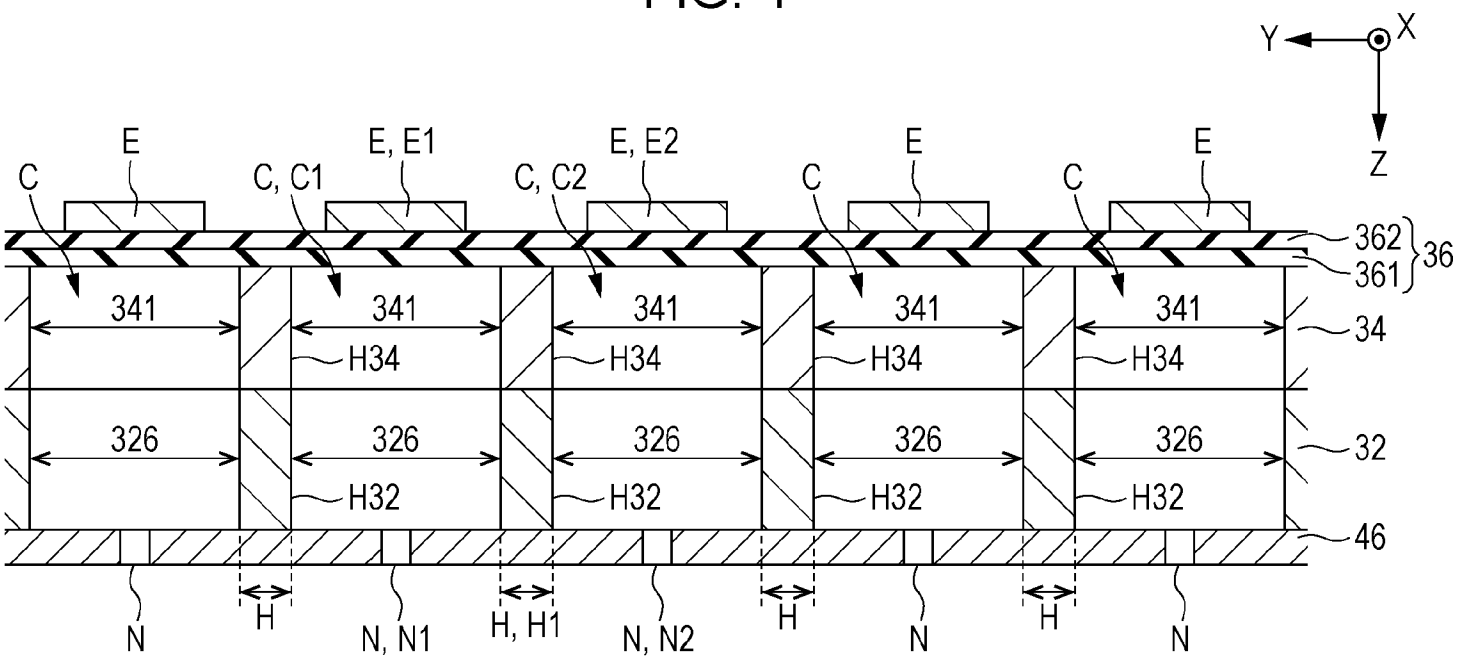
FIG. 4 is a cross-sectional view taken along a line IV-IV illustrated in FIG. 3.

FIG. 4 is a cross-sectional view taken along a line IV-IV illustrated in FIG. 3. As exemplified in FIG. 4, the plurality of pressure chambers C arrayed in the Y-axis direction are defined by partition walls H, each of which is a structural body partitioning pressure chambers C adjacent to each other. The partition walls H constitute portions of wall surfaces of the pressure chambers C. The plurality of partition walls H corresponding to the plurality of pressure chambers C are formed. The partition walls H are formed so that the partition walls H extend from a surface of the vibrating plate 36 on the positive side in the Z-axis direction to a surface of the nozzle plate 46 on the negative side in the Z-axis direction. Specifically, ends of the partition walls H on the negative side in the Z-axis direction are in contact with the vibrating plate 36, while other ends of the partition walls H on the positive side in the Z-axis direction are in contact with the nozzle plate 46.

Specifically, each of the partition walls H includes a first portion H32 and a second portion H34. The first portions H32 are formed in the first channel substrate 32. The second portions H34 are formed in the second channel substrate 34. It can be said that the first portions H32 of the partition walls H define the communication channels 326 and that the second portions H34 of the partition walls H define the pressurization channels 341. The first portions H32 and the second portions H34 are bonded to each other via, for example, an adhesive. The communication channels 326 and the pressurization channels 341 overlap the nozzles N in a plan view.

Figure 5:
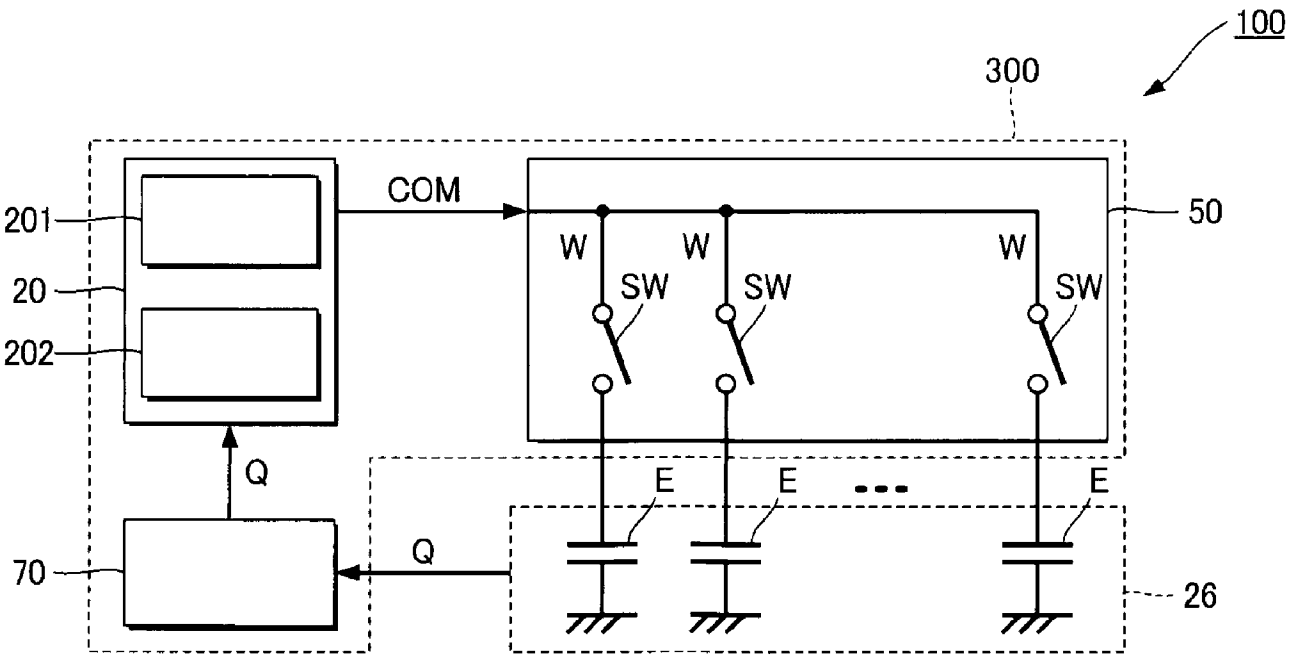
FIG. 5 is a block diagram exemplifying a functional configuration of the liquid ejecting apparatus.

FIG. 5 is a block diagram exemplifying a functional configuration of the liquid ejecting apparatus 100. The liquid ejecting apparatus 100 according to the first embodiment executes a printing operation and an inspection operation. The printing operation is executed to print an image by ejecting the ink onto the medium 12. The inspection operation is executed to inspect whether a structural defect exists in the pressure chambers C.

As exemplified in FIG. 5, the liquid ejecting apparatus 100 includes a controller 300. The controller 300 controls the printing operation and the inspection operation. The controller 300 according to the first embodiment includes the foregoing control unit 20, a driving circuit 50, and a detecting circuit 70. The driving circuit 50 and the detecting circuit 70 are electrically coupled to the control unit 20 and are mounted on, for example, a wiring substrate mounted on the surface of the vibrating plate 36. The wiring substrate is, for example, a flexible substrate such as a chip-on film (COF), a flexible printed circuit (FPC), or a flexible flat cable (FFC).

The control unit 20 includes a signal generating unit 201 and a processing unit 202. The signal generating unit 201 generates the driving signal COM to drive the driving elements E and supplies the driving signal COM to the driving circuit 50. The driving circuit 50 supplies the driving signal COM to the driving elements E. Specifically, the driving circuit 50 includes a plurality of switches SW corresponding to the different driving elements E and a circuit for controlling states of the switches SW. The circuit for controlling the states of the switches SW is not illustrated. When the switches SW corresponding to the driving elements E are turned on, a specific section of the driving signal COM is supplied to the driving elements E.

The driving signal COM according to the first embodiment includes an ejection waveform W1, a micro-vibration waveform W2, and an inspection waveform W3. When the driving circuit 50 controls the switches SW, the controller 300 can selectively supply any of the ejection waveform W1, the micro-vibration waveform W2, and the inspection waveform W3 to arbitrary one or more of the driving elements E. In the printing operation, the ejection waveform W1 or the micro-vibration waveform W2 is supplied from the controller 300 to each of the driving elements E. Specifically, the ejection waveform W1 is supplied to a driving element E corresponding to a nozzle N that will eject the ink, while the micro-vibration waveform W2 is supplied to a driving element E corresponding to a nozzle N that will not eject the ink. In the inspection operation, the micro-vibration waveform W2 and the inspection waveform W3 are supplied from the controller 300 to each of the driving elements E.

Figure 6:
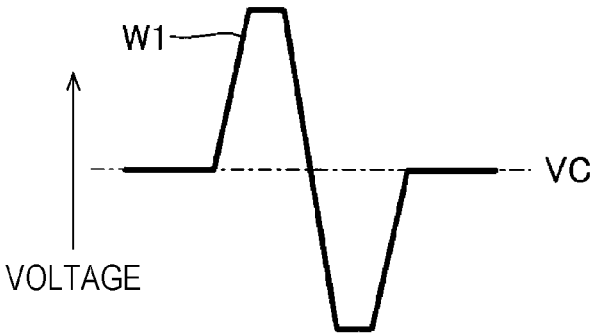
FIG. 6 is a waveform diagram of an ejection waveform.
Figure 7:
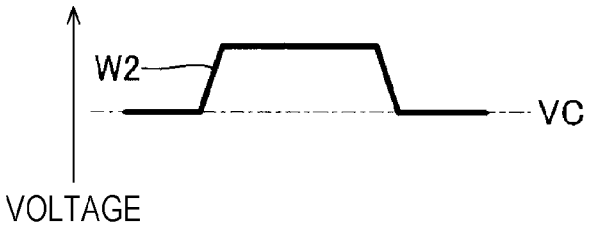
FIG. 7 is a waveform diagram of a micro-vibration waveform.
Figure 8:
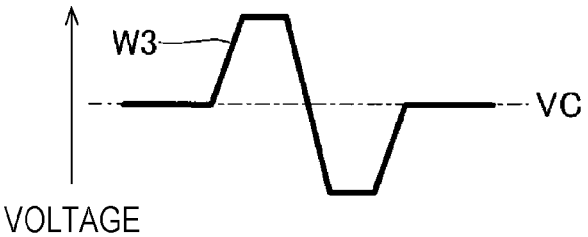
FIG. 8 is a waveform diagram of an inspection waveform.

FIG. 6 is a waveform diagram of the ejection waveform W1. FIG. 7 is a waveform diagram of the micro-vibration waveform W2. FIG. 8 is a waveform of the inspection waveform W3. The ejection waveform W1 is a waveform for ejecting the ink within a pressure chamber C from a nozzle N. As exemplified in FIG. 6, the ejection waveform W1 is a voltage signal indicating a voltage that changes to a lower voltage than a voltage VC and to a higher voltage than the voltage VC. When the ejection waveform W1 is supplied to the driving elements E from the driving circuit 50, the ink with which the pressurization channels 341 are filled passes through the communication channels 326 and the nozzles N and is ejected.

The micro-vibration waveform W2 is a waveform for causing the ink within a pressure chamber C corresponding to the nozzle N to slightly vibrate without ejecting the ink from a nozzle N. As exemplified from FIG. 7, the micro-vibration waveform W2 is a voltage signal indicating a voltage that changes to a lower voltage than the voltage VC and to a higher voltage than the voltage VC. For example, the micro-vibration waveform W2 has a trapezoidal shape and is used. When the micro-vibration waveform W2 is supplied to a driving element E via the driving circuit 50, the ink within a nozzle N corresponding to the driving element E slightly vibrates. It can be said that the micro-vibration waveform W2 is a waveform for causing meniscus of the ink within the nozzles N to vibrate.

In the printing operation, a time period for supplying the micro-vibration waveform W2 to the driving elements E is limited to a short time period, and thus the viscosity of the ink in the vicinity of the meniscus within the nozzles N is not increased due to the supply of the micro-vibration waveform W2. On the other hand, in the inspection operation, the micro-vibration waveform W2 is repetitively supplied to the driving elements E for a long time period. Since the meniscus within the nozzles N contacts air, the ink that exists near the meniscus within the nozzles N increases in viscosity due to evaporation of water. Therefore, when the micro-vibration waveform W2 is supplied for a long time period similarly to the inspection operation, the ink having the viscosity increased due to the water evaporation in the vicinity of the meniscus within the nozzles N is stirred and mixed with the ink within the nozzles N due to the slight vibration. As a result, the viscosity of the ink within the nozzles gradually increases. Then, in a case in which the viscosity of the ink within the nozzles N increases, even when the ink is, for example, solidified and the ejection waveform W1 is supplied to the driving elements E, the ink is not ejected from the nozzles N. It can be said that a state in which the ink is not ejected from the nozzles N even when the ejection waveform W1 is supplied to the driving elements E is a state in which the nozzles N are "closed". Specifically, in the state in which the nozzles N are closed, the meniscus within the nozzles N hardly vibrates based on fluctuations in the pressure within the pressure chambers C. Therefore, even when the ejection waveform W1 is supplied to the driving elements E, the ink is not ejected. When the micro-vibration waveform W2 is supplied to the driving elements E for a time period in a range of, for example, 15 seconds to 5 minutes, the nozzles N are closed. As understood from the above description, in the first embodiment, the micro-vibration waveform W2 is supplied to the driving elements E many times to increase the viscosity of the ink within the nozzles N and close the nozzles N by the ink with the increased viscosity. The shape of the micro-vibration waveform W2 is not limited to the shape exemplified in FIG. 7. For example, the micro-vibration waveform W2 may change to a lower voltage than the voltage VC. Alternatively, the micro-vibration waveform W2 may have a rectangular shape. Specifically, the micro-vibration waveform W2 is not limited to the waveform exemplified in FIG. 7 and may be arbitrarily changed as long as the micro-vibration waveform W2 causes the ink within the nozzles N to be stirred to the extent that the ink within the pressure chambers C is not ejected from the nozzles N.

The inspection waveform W3 is a waveform for causing the pressure of the ink within the pressure chambers C to fluctuate. As exemplified in FIG. 8, the inspection waveform W3 is, for example, a voltage signal indicating a voltage that changes to a lower voltage than the voltage VC and to a higher voltage than the voltage VC. The amplitude of the inspection waveform W3 is smaller than the amplitude of the ejection waveform W1. When the inspection waveform W3 is supplied to a driving element E via the driving circuit 50, the pressure of the ink within a pressure chamber C corresponding to the driving element E fluctuates. Fluctuations in the pressure within the pressure chambers C that are caused by the supply of the inspection waveform W3 is smaller than fluctuations in the pressure within the pressure chambers C that are caused by the supply of the ejection waveform W1. In the first embodiment, the inspection waveform W3 is supplied to a driving element E corresponding to a closed nozzle N. Therefore, when the inspection waveform W3 is supplied to the driving elements E, the pressure of the ink within the pressure chambers C fluctuates without the ejection of the ink from the nozzles N. The inspection waveform W3 is not limited to the waveform exemplified in the FIG. 8. Specifically, the inspection waveform W3 according to the first embodiment is arbitrary as long as the inspection waveform W3 causes the pressure within the pressure chambers C corresponding to the nozzles N to fluctuate. However, from the perspective of the inhibition of the ejection of the ink with the viscosity increased, a configuration in which fluctuations in the pressure within the pressure chambers C that occurred when the inspection waveform W3 was supplied are smaller than fluctuations in the pressure within the pressure chambers C that occurred when the ejection waveform W1 was supplied is suitable.

In the following description, as exemplified in FIG. 4, one of arbitrary two pressure chambers C that are among the plurality of pressure chambers C and adjacent to each other is referred to as "first pressure chamber C1", and the other of the arbitrary two pressure chambers C is referred to as "second pressure chamber C2". A nozzle N corresponding to the first pressure chamber C1 is referred to as "first nozzle N1" and a nozzle N corresponding to the second pressure chamber C2 is referred to as "second nozzle N2". A driving element E corresponding to the first pressure chamber C1 is referred to as "first driving element E1" and a driving element E corresponding to the second pressure chamber C2 is referred to as "second driving element E2". In addition, a partition wall H partitioning the first pressure chamber C1 and the second pressure chamber C2 is referred to as "first partition wall H1".

Figure 9:
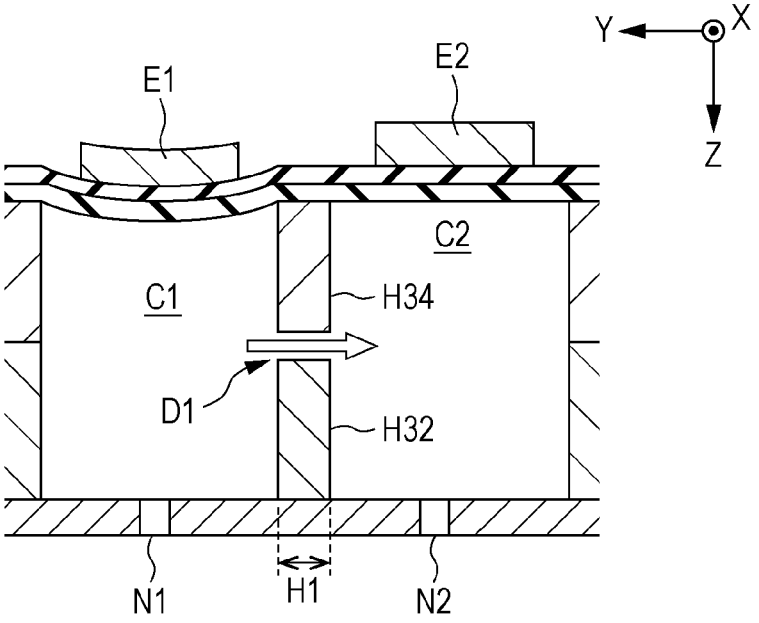
FIG. 9 is a cross-sectional view of first and second pressure chambers.

In the inspection operation according to the first embodiment, whether a defect D1 through which the first pressure chamber C1 communicates with the second pressure chamber C2 exists is inspected. FIG. 9 is a cross-sectional view of the first partition wall H1 in a state in which the defect D1 through which the first pressure chamber C1 communicates with the second pressure chamber C2 exists. As exemplified in FIG. 9, the defect D1 through which the first pressure chamber C1 communicates with the second pressure chamber C2 is, for example, peeling that has occurred at a joint section where a first portion H32 and a second portion H34 are joined to each other. As a result of the peeling between the first portion H32 and the second portion H34, the first pressure chamber C1 and the second pressure chamber C2 communicate with each other. Specifically, the ink flows from one of the first and second pressure chambers C1 and C2 to the other of the first and second pressure chambers C1 and C2. In the following description, a residual fluctuation in the pressure of the ink within a pressure chamber C corresponding to a driving element E after the supply of the driving signal COM to the driving element E is referred to as residual vibration.

In a state in which the defect D1 does not exist, a fluctuation Q in the pressure of the ink within the first pressure chamber C1 hardly propagates to the ink within the second pressure chamber C2. On the other hand, in the state in which the defect D1 exists, the fluctuation Q in the pressure of the ink within the first pressure chamber C1 propagates to the ink within the second pressure chamber C2 through the defect D1. The inspection operation according to the first embodiment includes a detection operation using the foregoing trend. Specifically, in the detection operation, a fluctuation Q in the pressure of the ink within the second pressure chamber C2 that occurred when the first driving element E1 was driven to cause the pressure of the ink within the first pressure chamber C1 to fluctuate is detected. The detection operation is executed without driving the second driving element E2. Specifically, the fluctuation Q in the pressure within the second pressure chamber C2 is caused by the fluctuation in the pressure within the first pressure chamber C1. In the detection operation, the first driving element E1 is driven by the supply of the inspection waveform W3. In the detection operation according to the first embodiment, the fluctuation Q in the pressure within the second pressure chamber C2 that was caused by the residual vibration within the first pressure chamber C1 when the inspection waveform W3 was supplied to the first driving element E1 is detected. Specifically, after the supply of the inspection waveform W3 to the first driving element E1 is terminated, the detection of the fluctuation Q in the pressure is started. Therefore, the fluctuation Q in the pressure within the second pressure chamber C2 due to the fluctuation in the pressure within the first pressure chamber C1 can be detected with high accuracy. As understood from the foregoing description, the inspection waveform W3 is supplied to the first driving element E1 to cause the pressure of the ink within the first pressure chamber C1 to fluctuate.

The detecting circuit 70 illustrated in FIG. 5 detects the fluctuation Q in the pressure within the second pressure chamber C2 in the detection operation. Specifically, for example, when the fluctuation in the pressure within the first pressure chamber C1 propagates to the second driving element E2, the detecting circuit 70 detects, as a voltage signal indicating a waveform of the fluctuation Q in the pressure, electromotive force that occurred in the second driving element E2. Specifically, in the detection operation, the second driving element E2 is used to detect the fluctuation Q in the pressure. The detecting circuit 70 detects the fluctuation Q in the pressure for a predetermined time period.

Figure 10:
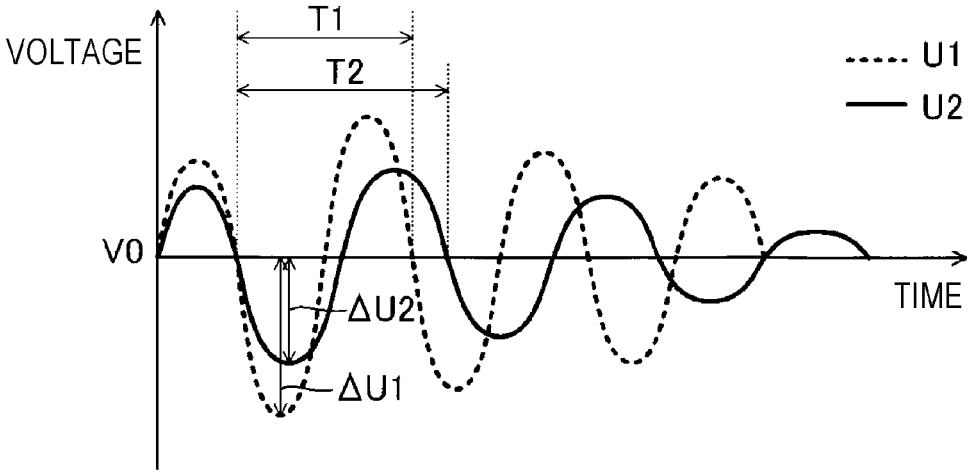
FIG. 10 is a waveform diagram illustrating voltages indicating residual vibrations within the first pressure chamber.

FIG. 10 is a waveform diagram of voltages indicating residual vibrations U within the first pressure chamber C1. In FIG. 10, a residual vibration U1 within the first pressure chamber C1 in a state in which the defect D1 does not exist in the first partition wall H1 is indicated by a dotted line, and a residual vibration U2 within the first pressure chamber C1 in a state in which the defect D1 exists in the first partition wall H1 is indicated by a solid line. In the state in which the defect D1 does not exist, the residual vibration U1 within the first pressure chamber C1 does not propagate to the ink within the second pressure chamber C2. On the other hand, in the state in which the defect D1 exists, the residual vibration U2 within the first pressure chamber C1 propagates to the ink within the second pressure chamber C2 through the defect D1. Specifically, the residual vibration U2 attenuates more easily than the residual vibration U1. Therefore, as exemplified in FIG. 10, an amplitude value ΔU2 of the residual vibration U2 is smaller than an amplitude value ΔU1 of the residual vibration U1, and a cycle T2 of a voltage indicating the residual vibration U2 is longer than a cycle T1 of a voltage indicating the residual vibration U1. The amplitude values ΔU are, for example, amplitudes of the residual vibrations U at the maximum peaks among a plurality of peaks of the residual vibrations U. Each of the amplitudes at the peaks is an absolute value of the difference between a voltage value VO serving as a standard and a peak value corresponding to the maximum absolute value at the peak. The amplitudes at the peaks are positive values. In the first embodiment, the voltage value VO is the voltage VC detected by the detecting circuit 70 in a state in which a vibration does not occur in the pressure chambers C. The voltage value VO is not limited to the voltage VC since the voltage value VO may be changed based on, for example, the shape of the inspection waveform W3 or the timing of detecting the residual vibrations U.

Figure 11:
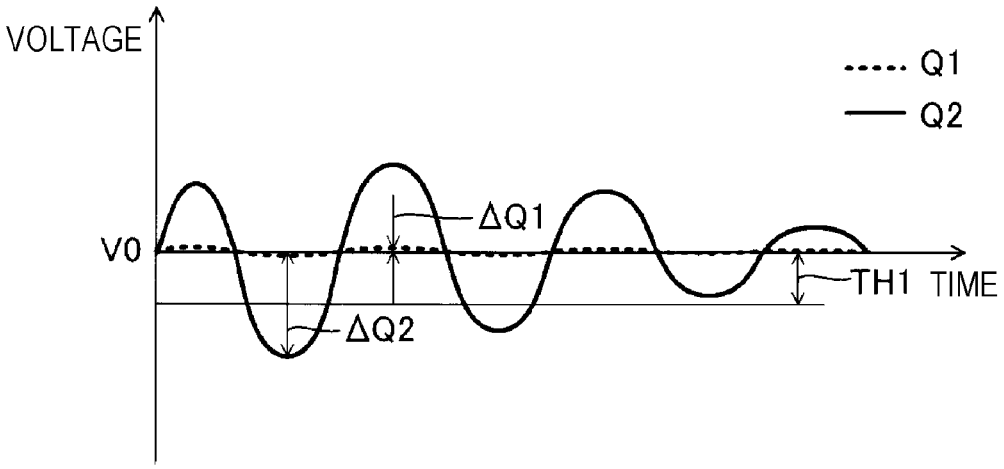
FIG. 11 is a waveform diagram illustrating voltages indicating fluctuations in pressure within the second pressure chamber.

FIG. 11 is a waveform diagram of voltages indicating fluctuations Q in the pressure within the second pressure chamber C2. Specifically, a fluctuation Q1 in the pressure that is detected in a state in which the defect D1 does not exist in the first partition wall H1 is indicated by a dotted line, and a fluctuation Q2 in the pressure that is detected in a state in which the defect D1 exists in the first partition wall H1 is indicated by a solid line. FIG. 11 illustrates an amplitude value ΔQ of a voltage indicating the fluctuation Q in the pressure within the second pressure chamber C2. Specifically, FIG. 11 illustrates an amplitude value ΔQ1 of the fluctuation Q1 in the pressure in the state in which the defect D1 does not exist and an amplitude value ΔQ2 of the fluctuation Q2 in the pressure in the state in which the defect D1 exists. In the state in which the defect D1 does not exist, the residual vibration U1 within the first pressure chamber C1 does not propagate to the ink within the second pressure chamber C2. Therefore, as exemplified in FIG. 11, the fluctuation Q1 in the pressure is nearly constant. On the other hand, as exemplified in FIG. 9, in the state in which the defect D1 exists in the first partition wall H1, the residual vibration U2 within the first pressure chamber C1 propagates to the ink within the second pressure chamber C2. Therefore, as exemplified in FIG. 11, the large fluctuation Q2 in the pressure occurs due to the residual vibration U2. Specifically, the amplitude value ΔQ2 of the fluctuation Q2 in the pressure is larger than the amplitude value ΔQ1 of the fluctuation Q1 in the pressure. The amplitude values ΔQ of the fluctuations Q in the pressure are, for example, amplitudes when the voltages indicating the fluctuations Q in the pressure are at the maximum peaks among a plurality of peaks of the voltages indicating the fluctuations Q in the pressure. Amplitudes of the voltages indicating the fluctuations Q in the pressure when the voltages are at arbitrary peaks among the plurality of peaks of the voltages are used as the amplitude values ΔQ of the voltages indicating the fluctuations Q in the pressure.

In consideration of the foregoing trend, the processing unit 202 of the control unit 20 determines whether the defect D1 exists in the first partition wall H1 based on the fluctuation Q, detected by the detecting circuit 70, in the pressure within the second pressure chamber C2. Specifically, the processing unit 202 compares a first threshold TH1 with the amplitude value ΔQ of the voltage indicating the fluctuation Q in the pressure within the second pressure chamber C2 and determines whether the defect D1 exists in the first partition wall H1. The first threshold TH1 illustrated in FIG. 11 is set based on, for example, the amplitude value ΔQ1 of the voltage indicating the fluctuation Q1 in the pressure that is assumed in the state in which the defect D1 does not exist in the first partition wall H1. The first threshold TH1 is a positive value. Specifically, when the amplitude value ΔQ of the fluctuation Q in the pressure within the second pressure chamber C2 is equal to or larger than the first threshold TH1, the processing unit 202 determines that the defect D1 exists in the first partition wall H1. On the other hand, when the amplitude value ΔQ of the fluctuation Q in the pressure within the second pressure chamber C2 is smaller than the first threshold TH1, the processing unit 202 determines that the defect D1 does not exist in the first partition wall H1.

As understood from the foregoing description, a pressure chamber C that is among the plurality of pressure chambers C and corresponds to a driving element E to which the inspection waveform W3 is supplied in the detection operation is the first pressure chamber C1, and a pressure chamber C that is among the plurality of pressure chambers C and in which a fluctuation Q in the pressure of the ink is to be detected in the detection operation is the second pressure chamber C2. In the inspection operation, whether a defect D1 exists in each of the plurality of partition walls H is determined. Specifically, a fluctuation Q in the pressure within each of the plurality of pressure chambers C is detected as a fluctuation in the pressure within the second pressure chamber C2.

Figure 12:
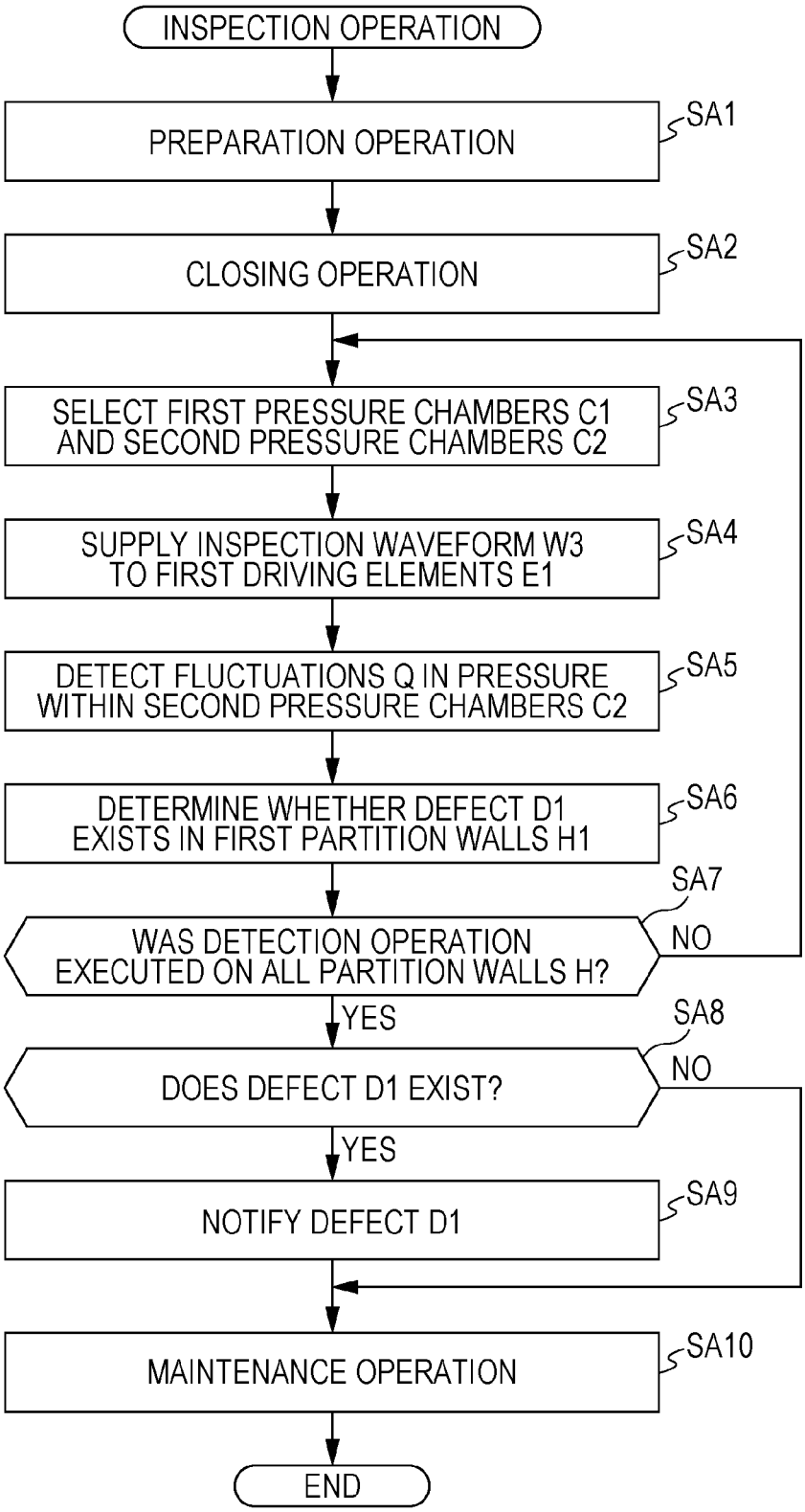
FIG. 12 is a flowchart of an inspection operation.
Figure 13:
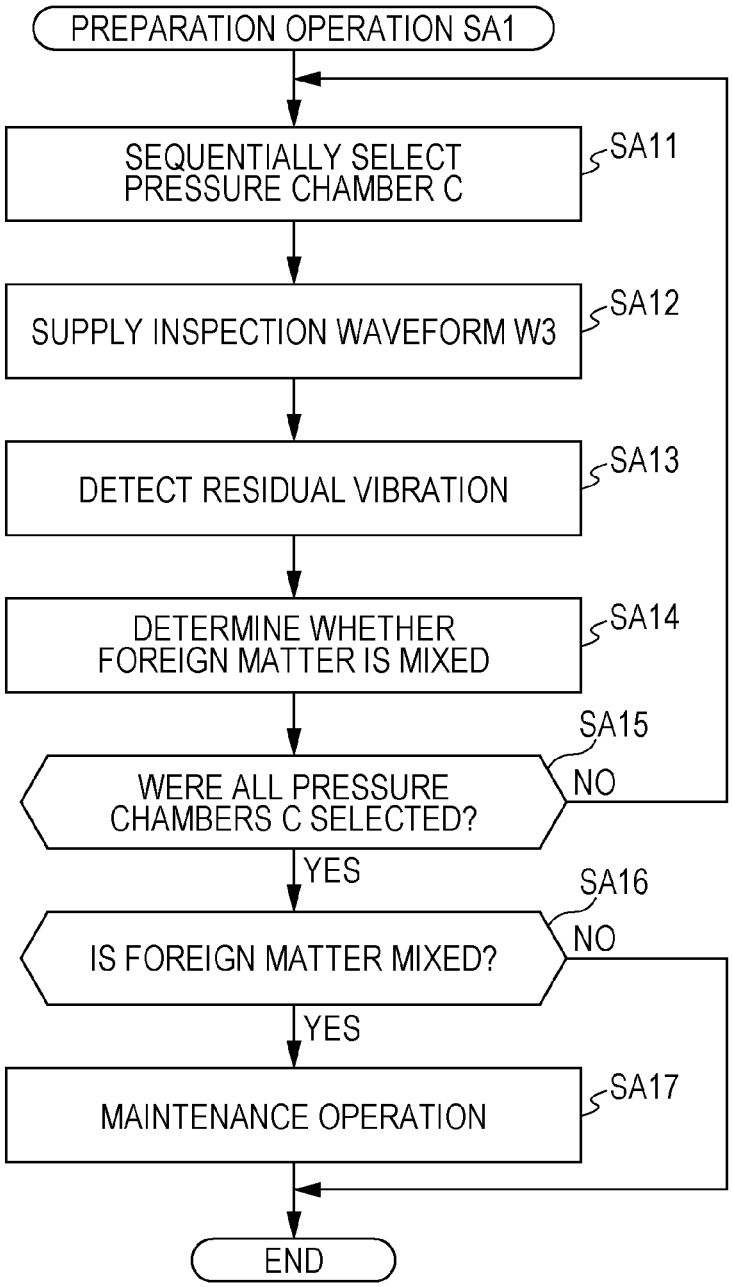
FIG. 13 is a flowchart of a preparation operation.

FIG. 12 is a flowchart of the inspection operation to be executed by the liquid ejecting apparatus 100. For example, the inspection operation is executed when a predetermined time period elapses after a user first uses the liquid ejecting apparatus 100. Alternatively, the inspection operation is executed when the printing operation is executed a predetermined number of times after the user first uses the liquid ejecting apparatus 100. When the inspection operation is started, the controller 300 executes a preparation operation (SA1). The preparation operation is an operation of removing a foreign matter such as a bubble or dust mixed in the ink within the pressure chambers C and the ink within the nozzles N. FIG. 13 is a flowchart of the preparation operation. The control unit 20 of the controller 300 sequentially selects an arbitrary one of the plurality of pressure chambers C as an inspection pressure chamber (SA11). Then, the driving circuit 50 supplies the inspection waveform W3 to a driving element E corresponding to the inspection pressure chamber (SA12). It can be said that the process of step SA11 is a process of selecting a driving element E to which the inspection waveform W3 is to be supplied. As the process of step SA12, the driving circuit 50 may supply the ejection waveform W1 to the driving element E corresponding to the inspection pressure chamber.

The detecting circuit 70 detects a residual vibration within the inspection pressure chamber (SA13). The processing unit 202 determines, based on the detected residual vibration, whether a foreign matter is mixed in the ink within the inspection pressure chamber and a nozzle N corresponding to the inspection pressure chamber (SA14). For example, when a bubble is mixed in the ink within the inspection pressure chamber or the nozzle N, a cycle of a voltage indicating the residual vibration detected in the inspection pressure chamber tends to be shorter than a cycle of a voltage indicating a residual vibration detected when a bubble is not mixed in the ink within the inspection pressure chamber and the nozzle N. In addition, when dust such as paper powder is mixed in the ink within the inspection pressure chamber or the nozzle N, an amplitude value of a residual vibration detected in the inspection pressure chamber tends to be smaller than an amplitude value of a residual vibration detected in a case in which dust such as paper powder is not mixed in the ink within the inspection pressure chamber and the nozzle N. In consideration of the foregoing trend, whether a foreign matter is mixed in the ink within the inspection pressure chamber and the nozzle N is determined based on the residual vibration. Specifically, when the cycle of the voltage indicating the residual vibration within the inspection pressure chamber is shorter than a predetermined threshold, the processing unit 202 determines that a bubble is mixed in the ink within the inspection pressure chamber or the nozzle N. When the cycle of the voltage indicating the residual vibration within the inspection pressure chamber is longer than the threshold, the processing unit 202 determines that a bubble is not mixed in the ink within the inspection pressure chamber and the nozzle N. In addition, when the amplitude value of the residual vibration within the inspection pressure chamber is smaller than a predetermined threshold, the processing unit 202 determines that dust such as paper powder is mixed in the ink within the inspection pressure chamber or the nozzle N. When the amplitude value is larger than the threshold, the processing unit 202 determines that dust such as paper powder is not mixed in the ink within the inspection pressure chamber and the nozzle N. The controller 300 determines whether the controller 300 executed a process of determining whether a foreign matter is mixed in the ink within all the pressure chambers C (SA15). Specifically, whether all the pressure chambers C were selected as inspection pressure chambers is determined.

When the controller 300 determines that a pressure chamber C that is not yet selected as an inspection pressure chamber exists (NO in SA15), the process returns to step SA11. On the other hand, when the controller 300 determines that all the pressure chambers C were selected as the inspection pressure chambers (YES in SA15), the processing unit 202 determines whether a pressure chamber C determined as a pressure chamber in which a foreign matter is mixed in the ink in step SA14 exists (SA16). When the pressure chamber C determined as the pressure chamber in which the foreign matter is mixed in the ink exists (YES in SA16), the controller 300 executes a maintenance operation of discharging the ink from a nozzle N (SA17). The maintenance operation is executed to remove a foreign matter within the pressure chamber C and the nozzle N. The maintenance operation is, for example, a flashing operation of forcibly ejecting the ink from the plurality of nozzles N. In the flashing operation, a flashing waveform that causes the ink within the pressure chambers C to vibrate more strongly than the ejection waveform W1 is supplied to the driving elements E. When the flashing operation is executed as the maintenance operation, the controller 300 may supply the flashing waveform to only the pressure chamber C determined as the pressure chamber in which the foreign matter is mixed in the ink. In addition, the maintenance operation may be a cleaning operation of forcibly discharging the ink from the plurality of nozzles N by executing pressurization from the upstream of the liquid ejecting head 26 or suction from the downstream of the liquid ejecting head 26 or may be a circulation operation of circulating the ink within the pressure chambers C. On the other hand, when a foreign matter is mixed in the ink within all the pressure chambers C (NO in SA16), the controller 300 terminates the preparation operation SA1 without executing the maintenance operation.

Figure 14:
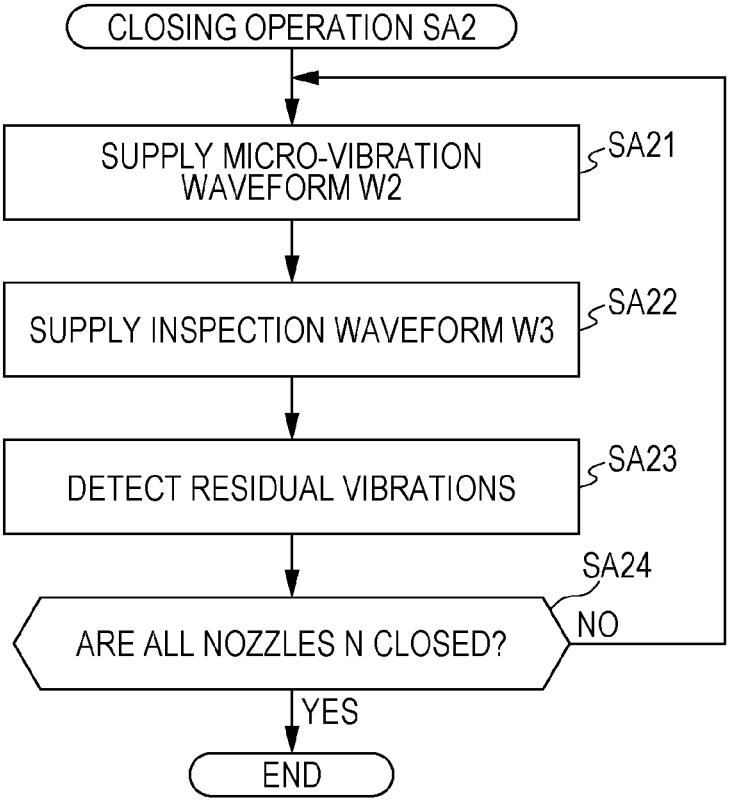
FIG. 14 is a flowchart of a closing operation.

When the preparation operation is terminated, the controller 300 executes a closing operation (SA2). The closing operation is a process of closing each of the plurality of nozzles N. FIG. 14 is a flowchart of the closing operation. The controller 300 repetitively supplies the micro-vibration waveform W2 to each of the plurality of driving elements E for a predetermined time period (SA21). Specifically, the viscosity of the ink within the nozzles N is increased. Next, the controller 300 supplies the inspection waveform W3 to each of the driving elements E (SA22). The controller 300 detects residual vibrations within the pressure chambers C corresponding to the driving elements E to which the inspection waveform W3 was supplied (SA23). The residual vibrations are sequentially detected for the plurality of pressure chambers C. Residual vibrations within the pressure chambers C when the ejection waveform W1 is supplied to the driving elements E may be detected.

The controller 300 determines, based on the residual vibrations detected for the pressure chambers C, whether the nozzles N corresponding to the pressure chambers C are closed (SA24). For example, a cycle of a voltage indicating a residual vibration detected when an increase in the viscosity of the ink within a nozzle N is sufficiently progressed tends to be longer than a cycle of a voltage indicating a residual vibration detected when an increase in the viscosity of the ink within the nozzle N is insufficient. In consideration of the foregoing trend, when a cycle of a voltage indicating a residual vibration exceeds a predetermined threshold, the controller 300 determines that the nozzle N is closed. When the cycle is lower than the threshold, the controller 300 determines that the nozzle N is not closed. In addition, an amplitude value of a voltage indicating a residual vibration detected when an increase in the viscosity of the ink within the nozzle N is sufficiently progressed tends to be smaller than an amplitude value of a voltage indicating a residual vibration detected when the increase in the viscosity of the ink within the nozzle N is insufficient. Therefore, when the amplitude value of the voltage indicating the residual vibration is smaller than the predetermined threshold, the controller 300 may determine that the nozzle N is closed. When the amplitude value of the voltage indicating the residual vibration exceeds the predetermined threshold, the controller 300 may determine that the nozzle N is not closed.

When a nozzle N that is among the plurality of nozzles N and is not closed exists (NO in SA24), the controller 300 supplies the micro-vibration waveform W2 to a driving element E corresponding to the nozzle N determined as not being closed (SA21). On the other hand, when all the nozzles N are closed (YES in SA24), the controller 300 terminates the closing operation. As understood from the foregoing description, the micro-vibration waveform W2 is repeatedly supplied until all the nozzles U are closed.

When the closing operation is terminated, the controller 300 sequentially selects different combinations of first pressure chambers C1 and second pressure chambers C2 from among the plurality of pressure chambers C (SA3). Specifically, for example, the controller 300 sequentially selects the second pressure chambers C2 in order from a pressure chamber C located at one of ends of an array of the plurality of pressure chambers C to a pressure chamber located at the other end of the array of the plurality of pressure chambers C and sequentially selects the first pressure chambers C adjacent to the selected second pressure chambers C. Therefore, for example, a pressure chamber C selected as a first pressure chamber C1 in the n-th selection is selected as a second pressure chamber C2 in the n+1-th selection. It can be said that the process of step SA3 is a process of selecting first driving elements E1 and second driving elements E2 from among the plurality of driving elements E.

Then, the controller 300 supplies the inspection waveform W3 to the first driving elements E1 (SA4). Therefore, the pressure within the first pressure chambers C1 fluctuates. The controller 300 detects fluctuations Q in the pressure within the second pressure chambers C2 (SA5). Steps SA4 and SA5 correspond to the detection operation. In the detection operation according to the first embodiment, after the supply of the inspection waveform W3 to the first driving elements E1 is terminated, the detection of the fluctuations Q in the pressure is started. Specifically, before residual vibrations within the first pressure chambers C1 that were caused by the supply of the inspection waveform W3 completely attenuate, the detection of the fluctuations Q in the pressure is started. As understood from the foregoing description, in the first embodiment, the detection operation is executed in a state in which the first and second nozzles N1 and N2 are closed.

The controller 300 determines whether a defect D1 exists in each of the first partition walls H1 based on the fluctuations Q in the pressure that were detected in the detection operation (SA6). Specifically, when an amplitude value ΔQ of a voltage indicating a fluctuation Q in the pressure is equal to or larger than the first threshold TH1, the controller 300 determines that the defect D1 exists. When the amplitude value ΔQ is smaller than the first threshold TH1, the controller 300 determines that the defect D1 does not exist. As understood from the foregoing description, it can be said that the detection operation according to the first embodiment is executed on each of the partition walls H. The controller 300 determines whether the presence or absence of the defect D1 was determined for all the partition walls H (SA7). In other words, the controller 300 determines whether the detection operation was executed on all the pressure chambers C.

When the detection operation is executed on all the partition walls H (YES in SA7), the controller 300 determines whether the defect D1 exists in any of the plurality of partition walls H (SA8). Specifically, the controller 300 determines whether a first partition wall H1 determined as having the defect D1 in step SA6 exists. When the defect D1 exists (YES in SA8), the controller 300 notifies the defect D1 to the user (SA9). For example, the controller 300 notifies the existence of the defect D1 by causing a display device to execute displaying or causing a sound emitting device to emit a sound. After notifying the defect D1, the controller 300 executes the maintenance operation (SA10). When the defect D1 does not exist in all the plurality of partition walls H (NO in SA8), the maintenance operation is executed without the execution of the process of step SA9.

The maintenance operation is, for example, the flashing operation, the cleaning operation, or the circulation operation. When the flashing operation is executed as the maintenance operation, the ink is not ejected in the supply of the ejection waveform W1 to the driving elements E in the closing operation of step SA2, but the viscosity of the ink is increased to the extent that the ink is ejected when the flashing waveform is supplied to the driving elements E. When the cleaning operation is executed as the maintenance operation, increases in the viscosity of the ink may be progressed to the extent that the ink is not ejected even when the flashing waveform is supplied to the driving elements E in the closing operation of step SA2. Therefore, vibrations of the meniscus within the nozzles N are suppressed, compared to a configuration in which the flashing operation is executed, and thus the fluctuations Q in the pressure within the second pressure chambers C2 can be detected with high accuracy. On the other hand, in the configuration in which the flashing operation is executed as the maintenance operation, the amount of the ink to be discharged in the maintenance operation can be reduced, compared to a configuration in which the cleaning operation is executed. As understood from the foregoing description, the maintenance operation is executed after the execution of the detection operation. Therefore, it is possible to eliminate a local increase in the viscosity of the ink in the closing operation. Specifically, the state in which the nozzles N are closed is canceled after the detection operation.

On the other hand, when a partition wall H on which the detection operation is not executed exists (NO in SA7), the process returns to step SA3 and the controller 300 selects, as a second pressure chamber C2, a pressure chamber C corresponding to the partition wall H on which the detection operation is not executed, and the controller 300 selects, as a first pressure chamber C1, a pressure chamber C adjacent to the selected second pressure chamber C2. Specifically, the processes of steps SA3 to SA7 are repeatedly executed until whether a defect D1 exists is determined for all the partition walls H.

In the inspection operation, when the controller 300 determines that defects D1 exist in partition walls H that are among the plurality of partition walls H and the number of partition walls H in which the defects D1 exist exceeds a predetermined threshold, the controller 300 may notify that the defects D1 exist. In other words, when the number of defects D1 is small and does not affect the accuracy of printing, the controller 300 may not notify the existence of the defects D1. In addition, a configuration in which the controller 300 notifies the defect D1 when the controller 300 determines that the defect D1 exists in step SA6 may be used. In the foregoing configuration, the detection operation may not be executed on an unprocessed partition wall H when the controller 300 determines that a defect D1 exists.

For example, a first comparative example assumes a configuration in which a residual vibration within a pressure chamber C to which an inspection waveform W3 is supplied is used to determine whether a defect D1 exists. A residual vibration detected when the viscosity of ink within the pressure chamber C increases tends to be approximate to a residual vibration detected when a partition wall H within the pressure chamber C is peeled. Therefore, in the first comparative example, whether a defect is caused by an increase in the viscosity of the ink within the pressure chamber C or by the peeling of the partition wall H within the pressure chamber C cannot be determined. Specifically, in the first comparative example, whether the structural defect D1 within the pressure chamber C exists cannot be determined. The structural defect D1 within the pressure chamber C is typically peeling of the partition wall H within the pressure chamber C.

On the other hand, in the configuration according to the first embodiment, in a case in which a defect D1 exists in a first partition wall H1, when a driving element E1 is driven, a fluctuation Q in the pressure of the ink within a second pressure chamber C2 occurs due to a fluctuation in the pressure of the ink within a first pressure chamber C1. In a case in which the defect D1 does not exist in the first partition wall H1, even when the first driving element E1 is driven, the fluctuation Q in the pressure within the second pressure chamber C2 hardly occurs, regardless of whether the viscosity of the ink within the second pressure chamber C2 increases. As understood from the foregoing description, according to the first embodiment, in the configuration in which the fluctuation Q in the pressure within the second pressure chamber C2 due to the driving of the first driving element E1 is detected, whether the defect D1 exists can be determined using the fluctuation Q in the pressure. Specifically, the structural defect D1 within the pressure chamber C can be detected.

In addition, a second comparative example assumes a configuration for using a method different from the first embodiment to determine whether a defect is caused by an increase in the viscosity of ink within a pressure chamber C or by peeling of a partition wall H within the pressure chamber C. In the second comparative example, to determine whether the defect is caused by the increase in the viscosity of the ink or by the peeling of the partition wall H, a residual vibration that occurred when only a concerned driving element E was driven and a residual vibration that occurred when the concerned driving element E and an adjacent driving element E were simultaneously driven are detected. Specifically, in the second comparative example, to determine whether the partition wall H within the pressure chamber C is peeled, it is necessary to detect the residual vibrations using the different two methods for the pressure chamber C. Therefore, a configuration for determining whether the partition wall H within the pressure chamber C is peeled is complex. On the other hand, in the first embodiment, whether a defect D1 caused by the peeling of a first partition wall H1 exists can be determined by detecting a fluctuation Q in the pressure of the ink within a second pressure chamber C2 that occurred when a first driving element E1 was driven. Specifically, whether the first partition wall H1 is peeled can be determined when a fluctuation Q in the pressure within the second pressure chamber C2 is detected by the single method. Therefore, the structural defect D1 within the pressure chamber C can be detected by the simple configuration, compared to the second comparative example.

In the first embodiment, since the detection operation is executed in a state in which a fluctuation in the pressure of the ink within the second pressure chamber C2 due to the driving of the second driving element E2 does not occur, a fluctuation Q in the pressure of the ink within the second pressure chamber C2 due to a fluctuation in the pressure of the ink within the first pressure chamber C1 can be detected with high accuracy. Therefore, whether the defect D1 through which the first pressure chamber C1 communicates with the second pressure chamber C2 exists can be determined with high accuracy.

When the detection operation is executed without closing the first nozzle N1, the meniscus of the ink within the first nozzle N1 vibrates due to a fluctuation in the pressure of the ink within the first pressure chamber C1 and thus the fluctuation in the pressure within the first pressure chamber C1 easily attenuates. As a result, the fluctuation in the pressure within the first pressure chamber C1 hardly propagates to the ink within the second pressure chamber C2 through the defect D1 of the first partition wall H1. Specifically, even when the defect D1 occurs in the first partition wall H1, the fluctuation Q in the pressure within the second pressure chamber C2 due to the fluctuation in the pressure within the first pressure chamber C1 hardly occurs. On the other hand, according to the first embodiment, in the configuration in which the detection operation is executed in a state in which the first nozzle N1 is closed, the meniscus within the first nozzle N1 hardly vibrates and thus the fluctuation in the pressure within the first pressure chamber C1 easily propagates to the ink within the second pressure chamber C2 through a defective portion of the first partition wall H1. Therefore, the fluctuation Q in the pressure within the second pressure chamber C2 due to the fluctuation in the pressure within the first pressure chamber C1 can be detected with high accuracy. Specifically, whether the defect D1 exists in the first partition wall H1 can be determined with high accuracy.

Figure 15:
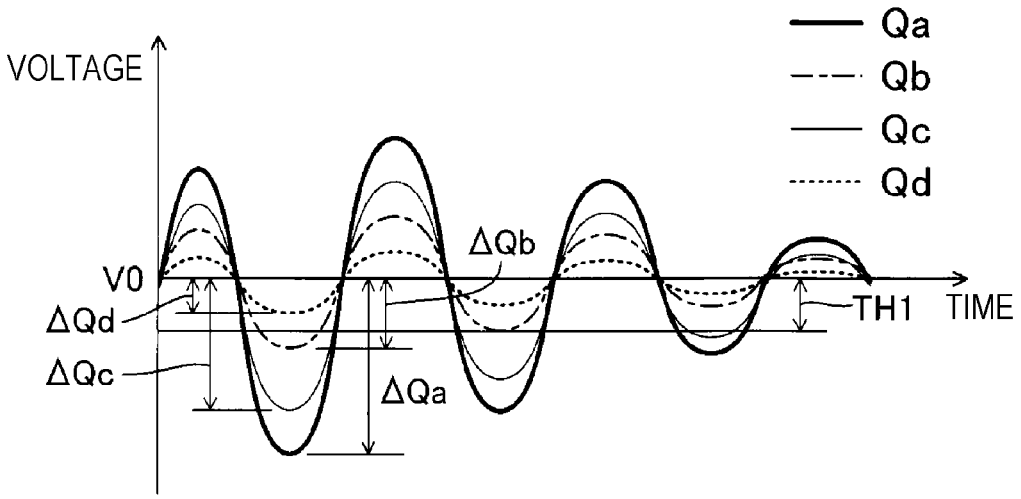
FIG. 15 is a waveform diagram of voltages indicating fluctuations in pressure within the second pressure chamber when a defect exists and when a defect does not exist.

FIG. 15 is a diagram describing the foregoing effects. Fluctuations Qa and Qb in the pressure that are illustrated in FIG. 15 are fluctuations Q in the pressure within the second pressure chamber when the detection operation is executed in a state in which the first nozzle N1 is closed. Fluctuations Qc and Qd in the pressure that are illustrated in FIG. 15 are fluctuations Q in the pressure within the second pressure chamber when the detection operation is executed in a state in which the first nozzle N1 is not closed. The fluctuations Qa and Qc in the pressure are the fluctuations Q in the pressure when the defect D1 is sufficiently large. The fluctuations Qb and Qd in the pressure are the fluctuations Q in the pressure when the defect D1 is small. The fact that the defect D1 is sufficiently large indicates that the peeling degree of the first partition wall H1 is large. The fact that the defect D1 is small indicates that the peeling degree of the first partition wall H1 is small.

As understood from the fluctuation Qc in the pressure that is illustrated in FIG. 15, even in a configuration in which the first nozzle N1 is not closed, when the defect D1 is sufficiently large, an amplitude value ΔQc exceeds the first threshold TH1. Therefore, the defect D1 can be detected. However, as understood from the fluctuation Qc in the pressure, in the configuration in which the first nozzle N1 is not closed, when the defect D1 is small, an amplitude value ΔQd is smaller than the first threshold TH1. Therefore, the defect D1 cannot be detected.

On the other hand, in the first embodiment in which the first nozzle N1 is closed, as understood from the fluctuation Qa in the pressure, when the defect D1 is sufficiently large, an amplitude value ΔQa exceeds the first threshold TH1 and thus the defect D1 can be detected. In addition, as understood from the fluctuation Qb in the pressure, even when the defect D1 is sufficiently small, an amplitude value ΔQb exceeds the first threshold TH1. Therefore, the defect D1 can be detected. As understood from the foregoing description, the first embodiment in which the first nozzle N1 is closed has an advantage that, even when the defect D1 is relatively small, the defect D1 can be detected with high accuracy.

In addition, when the detection operation is executed without closing the second nozzle N2, the meniscus within the second nozzle N2 vibrates due to a fluctuation in the pressure that propagated from the first pressure chamber C1 to the second pressure chamber C2 through the defect D1 of the first partition wall H1, and thus a fluctuation Q in the pressure within the second pressure chamber C2 easily attenuates. On the other hand, in a configuration in which the detection operation is executed in a state in which the second nozzle N2 is closed, the meniscus within the second nozzle N2 hardly vibrates and thus the fluctuation Q in the pressure within the second pressure chamber C2 hardly attenuates in the second pressure chamber C2. Therefore, whether the defect of the first partition wall H1 exists can be determined with high accuracy. In the first embodiment, by comparing the first threshold TH1 with the amplitude value, whether the defect D1 of the first partition wall H1 can be determined.

B. Second Embodiment

A second embodiment of the disclosure is described. In the following examples, elements having the same functions as those described in the first embodiment are indicated by the same reference signs as those described in the first embodiment, and a detailed description thereof are omitted.

Figure 16:
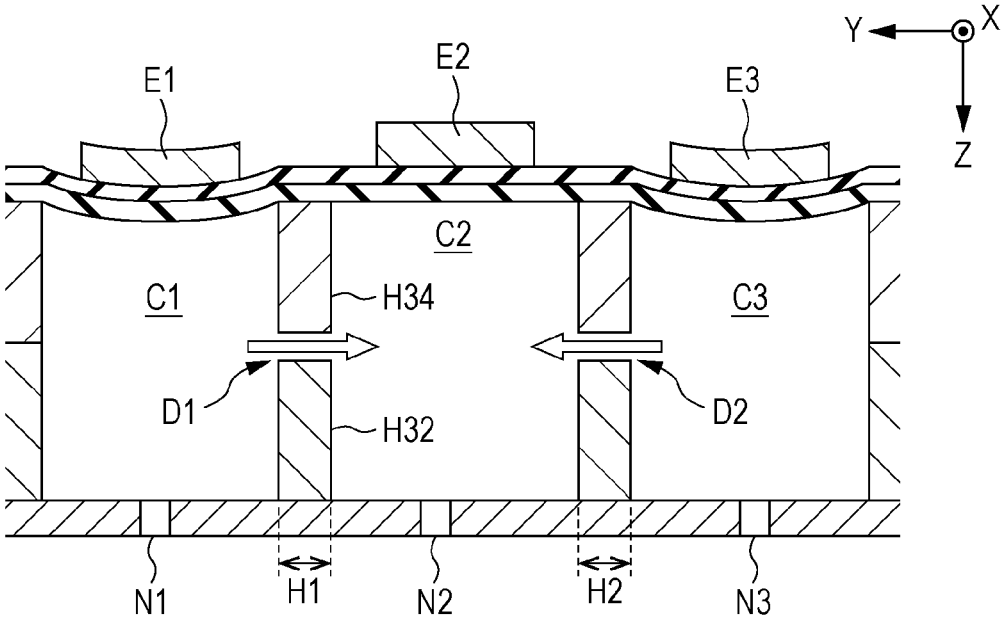
FIG. 16 is a cross-sectional view of first to third pressure chambers according to a second embodiment.

FIG. 16 is a cross-sectional view of a liquid ejecting head 26 according to the second embodiment. In the following description, as exemplified in FIG. 16, a pressure chamber C that is located adjacent to a second pressure chamber C2 on the opposite side to a first pressure chamber C1 so that the second pressure chamber C2 exists between the pressure chamber C and the first pressure chamber C1 is referred to as "third pressure chamber C3", a driving element E corresponding to the third pressure chamber C3 is referred to as "third driving element E3", and a nozzle N corresponding to the third pressure chamber C3 is referred to as "third nozzle N3". A partition wall H partitioning the second pressure chamber C2 and the third pressure chamber C3 is referred to as "second partition wall H2". In the first embodiment, the fluctuation Q in the pressure of the ink within the second pressure chamber C2 when the first driving element E1 is driven is detected. In the second embodiment, however, a fluctuation Q in the pressure of the ink within the second pressure chamber C2 when the first driving element E1 and the third driving element E3 are driven is detected.

Figure 17:
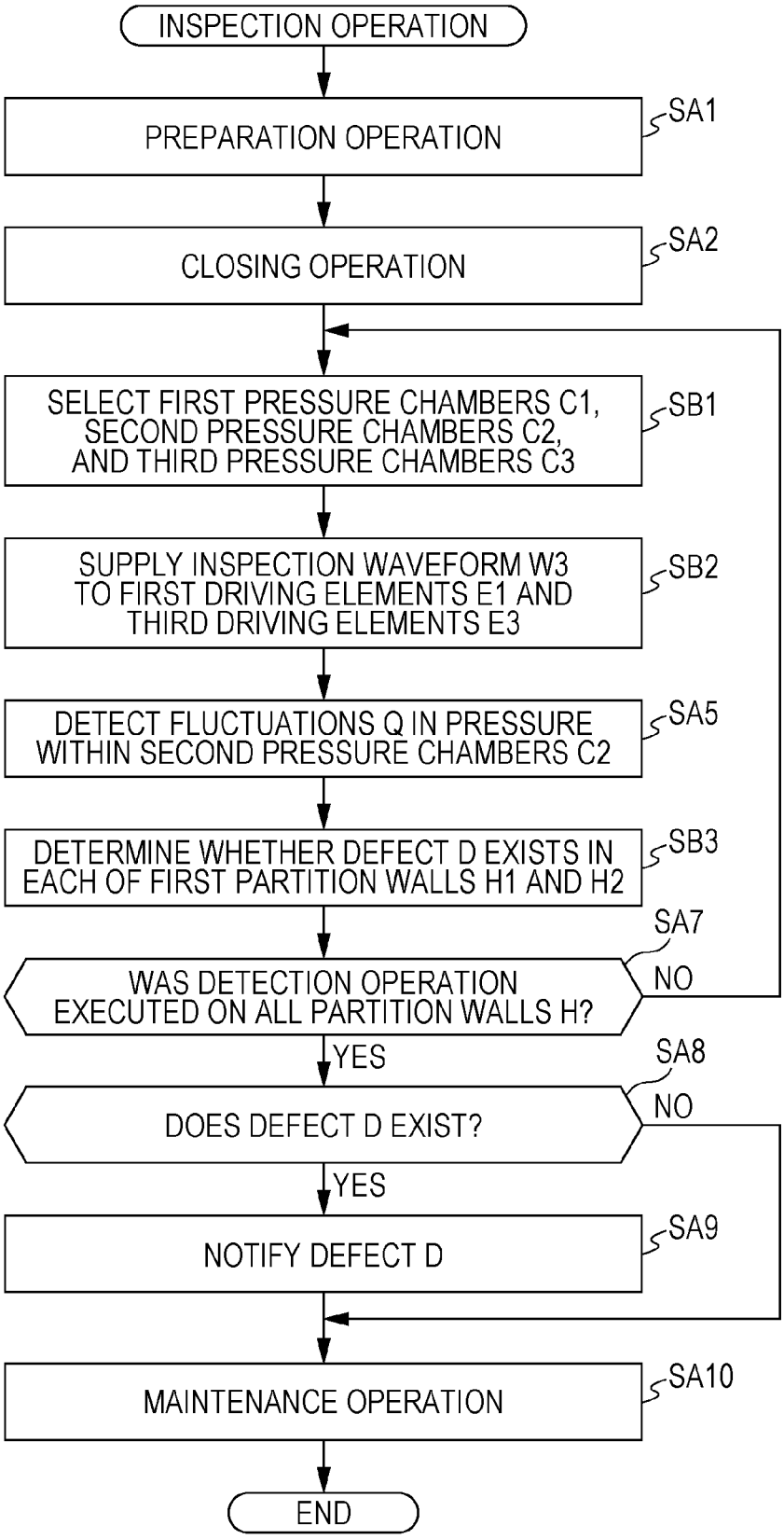
FIG. 17 is a flowchart of an inspection operation according to the second embodiment.

FIG. 17 is a flowchart of an inspection operation according to the second embodiment. In the inspection operation according to the second embodiment, step SA3 illustrated in FIG. 12 is replaced with step SB1, step SA4 is replaced with step SB2, and step SA6 is replaced with step SB3. Other steps are the same as those illustrated in FIG. 12. When the inspection operation is started, the controller 300 executes the preparation operation (SA1) and the closing operation (SA2) in the same manner as the first embodiment.

Figure 18:
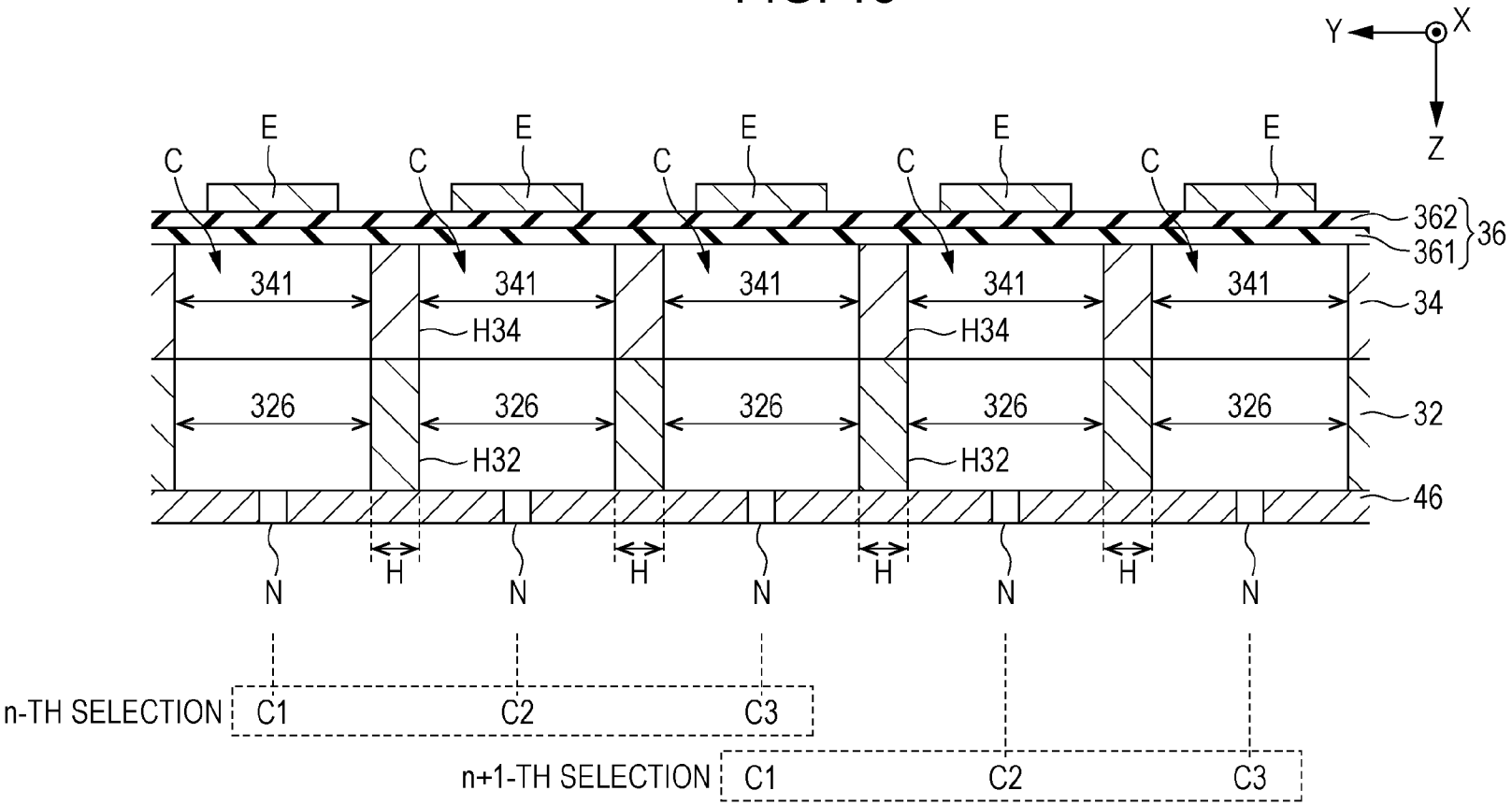
FIG. 18 is a cross-sectional view of a liquid ejecting apparatus according to the second embodiment.

Then, the controller 300 selects first pressure chambers C1, second pressure chambers C2, and third pressure chambers C3 from among a plurality of pressure chambers C (SB1). Different combinations of three pressure chambers C adjacent to each other are sequentially selected. Specifically, the controller 300 selects every other second pressure chamber C2 and selects the first pressure chambers C1 adjacent to the second pressure chambers C2 on one side of the second pressure chambers C2 and the third pressure chambers C3 adjacent to the second pressure chambers C2 on the other side of the second pressure chambers C2. FIG. 18 exemplifies pressure chambers C selected in step SB1 in the n-th selection and pressure chambers C selected in step SB1 in the n+1-th selection. As exemplified in FIG. 18, since every other second pressure chamber C2 is selected, a pressure chamber C selected as a third pressure chamber C3 in the n-th selection is selected as a first pressure chamber C1 in the n+1-th selection. In the foregoing example, the second pressure chambers C2 are sequentially selected in the order in which the plurality of pressure chambers C are arrayed. However, as long as every other second pressure chamber C2 is selected, the order in which the second pressure chambers C2 are selected is arbitrary. It can be said that the process of step SB1 is a process of selecting first driving elements E1, second driving elements E2, and third driving elements E3.

The controller 300 supplies the inspection waveform W3 to the first driving elements E1 and the third driving elements E3 (SB2). Therefore, the pressure within the first pressure chambers C1 and the pressure within the third pressure chambers C3 fluctuate. Then, the controller 300 detects fluctuations in the pressure within the second pressure chambers C2 (SA5). Specifically, the detection of the fluctuations within the second pressure chambers C is started after the termination of the supply of the inspection waveform W3 to the first driving elements E1 and the third driving elements E3. The processes of steps SB2 and SA5 are a detection operation of detecting fluctuations Q in the pressure of the ink within the pressure chambers C2 that occurred when the first driving elements E1 were driven to cause the pressure of the ink within the first pressure chambers C1 to fluctuate and the third driving elements E3 were driven to cause the pressure of the ink within the third pressure chambers C3 to fluctuate. In the second embodiment, the detection operation is executed in a state in which first nozzles N1, second nozzles N2, and third nozzles N3 are closed. The controller 300 determines whether a defect D exists in first partition walls H1 and second partition walls H2 (SB3).

As understood from the foregoing description, every other second pressure chamber C2 is selected from among the plurality of pressure chambers C. For example, when pressure chambers C located at even-numbered positions are sequentially selected as the second pressure chambers C2 from among the plurality of pressure chambers C, pressure chambers C located at odd-numbered positions are not selected as second pressure chambers C2. Specifically, the pressure chambers C located at the odd-numbered positions are not subjected to the detection of fluctuations Q in the pressure. In other words, in the detection operation, fluctuations Q in the pressure in the pressure chambers C adjacent to the second pressure chambers C2 are not to be detected.

FIG. 16 illustrates a case in which defects D exist in a first partition wall H1 and a second partition wall H2. As exemplified in FIG. 16, the controller 300 determines whether a defect D1 through which the first pressure chamber C1 communicates with the second pressure chamber C2 and a defect D2 through which the second pressure chamber C2 communicates with the third pressure chamber C3 exist. The defect D2 is peeling between a first portion H32 of the second partition wall H2 and a second portion H34 of the second partition wall H2. When the defects D1 and D2 do not need to be distinguished, each of the defects D1 and D2 is merely referred to as "defect D".

Figure 19:
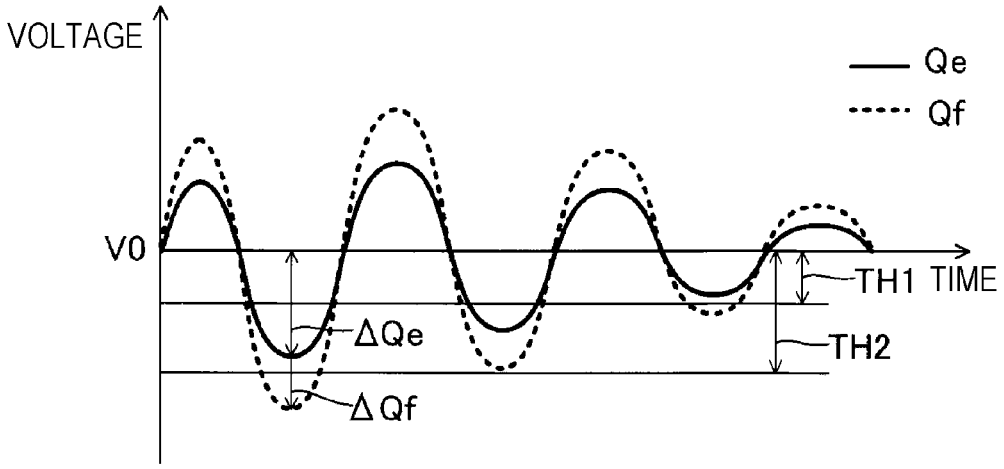
FIG. 19 is a waveform diagram of voltages indicating fluctuations in pressure within the second pressure chamber according to the second embodiment.

FIG. 19 illustrates a waveform diagram of a voltage indicating a fluctuation Qe in the pressure of the ink when a defect D exists in either the first partition wall H1 or the second partition wall H2 and a waveform diagram of a voltage indicating a fluctuation Qf in the pressure of the ink when the defects D exist in both the first partition wall H1 and the second partition wall H2. When the defects D exist in both the first partition wall H1 and the second partition wall H2, a fluctuation in the pressure of the ink within the first pressure chamber C1 due to the first driving element E1 propagates to the ink within the second pressure chamber C2 through the defect D1 of the first partition wall H1, and a fluctuation in the pressure of the ink within the third pressure chamber C3 due to the third driving element E3 propagates to the ink within the second pressure chamber C2 through the defect D2 of the second partition wall H2. Specifically, the fluctuations in the pressure within the first and third pressure chambers C1 and C3 propagate to the ink within the second pressure chamber C2. Therefore, the fluctuation Qf in the pressure is larger than the fluctuation Qe in the pressure. Specifically, as exemplified in FIG. 19, an amplitude value ΔQf of the fluctuation Qf in the pressure is larger than an amplitude value ΔQe of the fluctuation Qe in the pressure. In consideration of the foregoing trend, the controller 300 determines whether a defect D exists in either or each of the first partition wall H1 and the second partition wall H2.

Specifically, when an amplitude value ΔQ of a voltage indicating a fluctuation Q, detected in the detection operation, in the pressure within the second pressure chamber C2 is equal to or larger than the first threshold TH1, the controller 300 determines that the defect D1 exists in the first partition wall H1 or that the defect D2 exists in the second partition wall H2. In addition, when the amplitude value ΔQ of the voltage indicating the fluctuation Q, detected in the detection operation, in the pressure within the second pressure chamber C2 is equal to or larger than a second threshold TH2, the controller 300 determines that the defect D1 exists in the first partition wall H1 and that the defect D2 exists in the second partition wall H2. Specifically, when the amplitude value ΔQ of the voltage indicating the fluctuation Q in the pressure is equal to or larger than the first threshold TH1 and smaller than the second threshold TH2, the controller 300 determines that a defect D exists in either the first partition wall H1 or the second partition wall H2. When the amplitude value ΔQ is equal to or larger than the second threshold TH2, the controller 300 determines that the defects D exist in both the first and second partition walls H1 and H2. The first threshold TH1 is the same value as that described in the first embodiment and is, for example, set based on the amplitude value of the fluctuation Q in the pressure that is assumed when a defect D does not exist in the first and second partition walls H1 and H2. As exemplified in FIG. 19, the second threshold TH2 is set to be larger than the first threshold TH1. For example, it can be said that the second threshold TH2 is set based on the amplitude value ΔQe of the fluctuation Qe in the pressure. When the amplitude value of the voltage indicating the fluctuation Q in the pressure is smaller than the first threshold TH1, the controller 300 determines that the defects D do not exist in both the first and second partition walls H1 and H2. The processes of steps SA8 to SA10 are executed in the same manner as the first embodiment.

As understood from the foregoing description, whether the defects D exist in the first and second partition walls H1 and H2 can be determined by detecting fluctuations Q in the pressure within the second pressure chambers C that occurred when the first and third driving elements E1 and E3 were driven. In the second embodiment, especially, whether either one or both of the defects D1 and D2 has or have occurred can be determined by comparing the amplitude values ΔQ of the voltages indicating the fluctuations Q in the pressure with the first and second thresholds TH1 and TH2. Effects that are the same as or similar to those obtained in the first embodiment can be achieved in the second embodiment.

In the second embodiment, since every other second pressure chamber C2 is selected from among the plurality of pressure chambers C, whether a defect D exists in each of the partition walls H can be efficiently determined. In the second embodiment, every other second pressure chamber C2 may not be selected. Specifically, all the pressure chambers C may be sequentially selected as second pressure chambers C2.

When the n-th selection and the n+1-th selection are focused in step SB1, three pressure chambers (C1 to C3) selected in the n-th selection correspond to a "first pressure chamber", a "second pressure chamber", and a "third pressure chamber", and three pressure chambers (C1 to C3) selected in the n+1-th selection correspond to the "third pressure chamber", a "fourth pressure chamber", and a "fifth pressure chamber". A driving element E corresponding to the "fourth pressure chamber" corresponds to a "fourth driving element", and a driving element E corresponding to the "fifth pressure chamber" corresponds to a "fifth driving element". In addition, a nozzle N corresponding to the "fourth pressure chamber" corresponds to a "fourth nozzle", and a nozzle N corresponding to the "fifth pressure chamber" corresponds to a "fifth nozzle". In the second embodiment, the detection operation is sequentially executed on combinations of three pressure chambers (C1 to C3) selected in step SB1, but may be executed on a plurality of combinations of pressure chambers simultaneously.

C. Modifications

The embodiments exemplified above may be modified. Specific aspects of modifications that may be applied to the foregoing embodiments are exemplified as follows. Two or more aspects arbitrarily selected from the following examples may be combined without mutual contradiction.

(1) In each of the foregoing embodiments, although the peeling between the first portion H32 and the second portion H34 is exemplified as the defect D1 of the first partition wall H1, the defect D1 is not limited to the foregoing example. For example, peeling between the vibrating plate 36 and the first partition wall H1, peeling between the nozzle plate 46 and the first partition wall H1, or the like may be the defect D1. When the first pressure chamber C1 and the second pressure chamber C2 communicate with each other through the defect D1 without the common liquid reservoir R, whether the defect D1 exists can be determined using a fluctuation Q in the pressure that was detected in the detection operation. As understood from the foregoing description, the defect D1 that has occurred in the first partition wall H1 includes peeling between elements constituting the first partition wall H1 and peeling between the first partition wall H1 and an element joined to the first partition wall H1. The peeling between the elements constituting the first partition wall H1 is, for example, the peeling between the first portion H32 and the second portion H34. The peeling between the first partition wall H1 and the element joined to the first partition wall H1 is, for example, peeling between the vibrating plate 36 and the first partition wall H1 and peeling between the nozzle plate 46 and the first partition wall H1.

Similarly, the defect D2 through which the second pressure chamber C2 communicates with the third pressure chamber C3 is not limited to the peeling between the first portion H32 and the second portion H34. Peeling between the vibrating plate 36 and the second partition wall H2, peeling between the nozzle plate 46 and the second partition wall H2, or the like may be the defect D2. As long as the second pressure chamber C2 communicates with the third pressure chamber C3 through the defect D2 without the common liquid reservoir R, whether the defect D2 exists can be determined using a fluctuation Q in the pressure that was detected by the detection operation. As understood from the foregoing description, the defect D2 that has occurred in the second partition wall H2 includes peeling between elements constituting the second partition walls H2 and peeling between the second partition wall H2 and an element joined to the second partition wall H2. The peeling between the elements constituting the second partition wall H2 is, for example, peeling between the first portion H32 and the second portion H34. The peeling between the second partition wall H2 and the element joined to the second partition wall H2 is, for example, peeling between the vibrating plate 36 and the second partition wall H2 and peeling between the nozzle plate 46 and the second partition wall H2.

(2) In each of the foregoing embodiments, the ejection waveform W1 may be used as the inspection waveform W3. In the foregoing configurations, the driving signal COM may not include the inspection waveform W3. In addition, a configuration in which a waveform that causes the pressure within the pressure chambers C to fluctuate more largely than the ejection waveform W1 is used as the inspection waveform W3 may be used. In the foregoing configuration, for example, in the closing operation, the viscosity of the ink within the nozzles N may be increased until the ink is no longer ejected from the nozzles N even when the flashing waveform is supplied. Therefore, in the maintenance operation, the ink is discharged by the cleaning operation from the nozzles N. The configuration in which the waveform that causes the ink within the pressure chambers C to vibrate more largely than the ejection waveform W1 is used as the inspection waveform W3 has an advantage that a fluctuation in the pressure of the ink within the first pressure chamber C1 easily propagates to the ink within the second pressure chamber C2 through the defect D1.

(3) In each of the foregoing embodiments, the nozzles N are closed by supplying the micro-vibration waveform W2 to the driving elements E in the closing operation. The method for closing the nozzles N, however, is not limited to the foregoing example. For example, a configuration in which the nozzles N are closed by causing a contact portion to be in contact with an ejection surface in which the plurality of nozzles N are formed may be used. The ejection surface is, for example, a surface of the nozzle plate 46 on the positive side in the Z-axis direction. The contact portion is, for example, a plate-shaped elastic member. The controller 300 moves the contact portion so that the contact portion is in contact with the ejection surface in the closing operation. Specifically, openings of the nozzles N are closed by the contact portion. In this state, even when the ejection waveform W1 is supplied, the meniscus within the nozzles N does not vibrate. For example, a pressurizing mechanism may be mounted on the upstream with respect to the pressure chambers C, and the nozzles N may be closed by the contact portion in a state in which the pressure chambers C are pressurized by the pressurizing mechanism. When the ink within the pressure chambers C is pressurized, the nozzles N are closed by the contact portion in a state in which air does not exist between the contact portion and the meniscus.

The configuration in which the nozzles N are closed by the contact portion has an advantage that the nozzles N can be quickly closed without an increase in the viscosity of the ink within the nozzles N. On the other hand, according to the configuration in which the nozzles N are closed by supplying the micro-vibration waveform W2 to the driving elements E, the first nozzle N1 can be closed by a simple configuration, compared to the configuration in which the liquid ejecting apparatus 100 includes the contact portion.

The method for closing the nozzles N by increasing the viscosity of the ink within the nozzles N is not limited to the supply of the micro-vibration waveform W2 to the driving elements E. For example, the viscosity of the ink within the nozzles N may be increased by using a hygroscopic material such as glycerin to evaporate water of the ink within the nozzles N. By progressing the increase in the viscosity of the ink, the nozzles N are closed. For example, in the closing operation, the controller 300 moves the hydroscopic material to a position located opposite to the ejection surface. Alternatively, the viscosity of the ink within the nozzles N may be increased by using a heater or the like to heat the ink within the nozzles N. The heater is mounted at a position corresponding to each of the pressure chambers C or at a position located opposite to the ejection surface. The controller 300 controls the amount of heat to be produced by the heater so that the ink is not ejected from the nozzles N due to the heating of the heater.

(4) In each of the foregoing embodiments, the detection operation is executed in the state in which the first and second nozzles N1 and N2 are closed. The detection operation, however, may not be executed in the state in which the first and second nozzles N1 and N2 are closed. The detection operation may be executed without closing the first and second nozzles N1 and N2. Alternatively, the detection operation may be executed in a state in which either the first nozzles N1 or the second nozzles N2 are closed.

(5) In the first embodiment, the detection of fluctuations Q in the pressure within the second pressure chambers C2 is started after the termination of the supply of the inspection waveform W3 to the first driving elements E1. The time when the detection of the fluctuations Q in the pressure is started is not limited to the foregoing example. For example, a configuration in which the detection of the fluctuations Q in the pressure is started at the same time as the start of the supply of the inspection waveform W3 to the first driving elements E1 or within a time period for supplying the inspection waveform W3 to the first driving elements E1 may be used. In the configuration in which the detection of the fluctuations Q in the pressure is started at the same time as the start of the supply of the inspection waveform W3 to the first driving elements E1 or within the time period for supplying the inspection waveform W3 to the first driving elements E1, the fluctuations Q in the pressure within the second pressure chambers C2 due to fluctuations in the pressure within the first pressure chambers C1 can be detected with high accuracy.

The second embodiment is not limited to the configuration in which the detection of the fluctuations Q in the pressure within the second pressure chambers C2 is started after the termination of the supply of the inspection waveform W3 to the first and third driving elements E1 and E3. For example, the detection of the fluctuations Q in the pressure may be started at the same time as the start of the supply of the inspection waveform W3 to the first and third driving elements E1 and E3 or within a time period for supplying the inspection waveform W3 to the first and third driving elements E1 and E3. In the foregoing configuration, the fluctuations Q in the pressure within the second pressure chambers C2 due to fluctuations in the pressure within the first and third pressure chambers C1 and C3 can be detected with high accuracy.

(6) In the closing operation described in the embodiments, the controller 300 may determine that the nozzles N are closed when the micro-vibration waveform W2 is supplied to the driving elements E for a predetermined time period. Specifically, the process (SA22), illustrated in FIG. 14, of detecting residual vibrations is omitted. However, in the configuration that is described in each of the embodiments and in which the micro-vibration waveform W2 is supplied to the driving elements E corresponding to the nozzles N when the nozzles N are determined as not being closed, it is possible to suppress the execution of the detection operation in a state in which the first nozzles N1 are not closed.

(7) In each of the embodiments, a process of inhibiting the printing operation may be executed instead of or together with the process (SA9) of notifying a defect D. Specifically, when a defect D is determined as existing, at least one of the notification of the defect D and the inhibition of the printing operation is executed. When the defect D occurs, fluctuations in the pressure in the pressure chambers C may not propagate to the ink within the nozzles N and an error of an ejection characteristic may occur or the ink may not be ejected from the nozzles N. The ejection characteristic is, for example, an ejection speed, an ejection direction, or an ejection volume. Specifically, an operational failure occurs in the liquid ejecting apparatus 100. In a configuration in which the defect D is notified or the printing operation is inhibited, the execution of the printing operation can be inhibited in a state in which the liquid ejecting apparatus 100 has an operational failure. A configuration in which control is executed to inhibit two nozzles N that are adjacent to each other via a partition wall H determined as having a defect D from being used in the printing operation is suitable.

(8) Each of the foregoing embodiments assumes that, as the number of portions peeled in the partition walls H is larger or degrees of the peeling are larger, amplitude values of fluctuations Q in the pressure are larger. The controller 300 may use the foregoing trend to determine a degree of a defect D based on the amplitude values of the fluctuations Q in the pressure. In the foregoing configuration, the defect D may be notified only when the degree of the defect D is determined to affect the accuracy of the printing.

(9) Each of the embodiments exemplifies the configuration in which the single driving signal COM includes the ejection waveform W1, the micro-vibration waveform W2, and the inspection waveform W3. However, for example, a configuration in which individual driving signals COM include the ejection waveform W1, the micro-vibration waveform W2, and the inspection waveform W3 may be used.

(10) Each of the embodiments exemplifies the piezoelectric elements as the driving elements E. The driving elements E, however, are arbitrary as long as the driving elements E cause the pressure of the ink within the pressure chambers C to fluctuate. For example, vibrators such as electrostatic actuators may be used as the driving elements E. Alternatively, heating elements for causing the pressure within the pressure chambers C to fluctuate by heating may be used as the driving elements E.

(11) In each of the embodiments, the second driving elements E for causing the pressure within the second pressure chambers C2 to fluctuate are used to detect fluctuations Q in the pressure within the second pressure chambers C2. However, driving elements E for detection that are different from the second driving elements E2 may be used to detect the fluctuations Q in the pressure. The driving elements E for detection are not used to cause the pressure within the second pressure chambers C2 to fluctuate.

(12) In each of the embodiments, the preparation operation is executed before the execution of the closing operation and the detection operation, but may be omitted. However, in the configuration in which the preparation operation is executed, the fluctuations Q in the pressure within the second pressure chambers C2 can be detected with high accuracy.

(13) In each of the embodiments, whether a defect D1 exists is determined by comparing the first threshold TH1 with the amplitude values ΔQ of the voltages indicating the fluctuations Q, detected by the detection operation, in the pressure of the ink. The method for determining whether a defect D1 exists is not limited to the foregoing example. For example, whether a defect D exists may be determined using the average of the voltages indicating the fluctuations Q in the pressure, cycles of the voltages indicating the fluctuations Q in the pressure, or the like. The same applies to the defect D2.

(14) In each of the embodiments, in the preparation operation, whether a foreign matter mixed in the ink within a nozzle N exists is determined by detecting a residual vibration. The method for determining whether a foreign matter exists in the nozzles N is not limited to the detection of a residual vibration. For example, when a foreign matter is mixed in the ink within a nozzle N, the ink may be ejected in an erroneous direction. Therefore, for example, by optically detecting the ejection direction of the ink, whether a foreign matter exists may be determined. In addition, whether a foreign matter exists may be determined based on a result of printing a test pattern. Temperatures of the ink within the pressure chambers C may vary due to a foreign matter. Therefore, for example, whether a foreign matter exists may be determined based on temperatures detected by temperature sensors mounted in the pressure chambers C.

(15) In each of the embodiments, the maintenance operation is not limited to the flashing operation, the cleaning operation, and the circulation operation. For example, in the maintenance operation, the ejection surface may be wiped by a wiper, while the dissolution of the ink existing in the nozzles N and having the increased viscosity is promoted by causing water to adhere to the ejection surface.

(16) In each of the embodiments, the preparation operation is executed on all the pressure chambers C. The preparation operation, however, may be executed on only the second pressure chambers C2. Specifically, the preparation operation may not be executed on the first pressure chambers C1. In the first embodiment, all the pressure chambers C are selected as the second pressure chambers C2, and as a result, all the pressure chambers C are subjected to the preparation operation. On the other hand, in the second embodiment, since every other pressure chamber C is selected as the second pressure chambers C2 from among the plurality of pressure chambers C, the preparation operation is not required for the pressure chambers C that are not selected as second pressure chambers C2.

(17) The embodiments exemplify the serial-type liquid ejecting apparatuses 100, each of which has the transport body 242 storing the liquid ejecting head 26. The disclosure, however, may be applied to a line-type liquid ejecting apparatus 100 having a plurality of nozzles N that are distributed across an entire width of the medium 12.

(18) Each of the liquid ejecting apparatuses 100 exemplified in the embodiments may be used in an apparatus dedicated for printing and various apparatuses such as a facsimile machine and a copy machine. The liquid ejecting apparatuses disclosed herein may not be used for printing. For example, each of the liquid ejecting apparatuses may eject a solution for a color material and may be used as a manufacturing apparatus for forming a color filter of a display device such as a liquid display panel. In addition, each of the liquid ejecting apparatuses may eject a solution for a conductive material and may be used as a manufacturing apparatus for forming a wiring of a wiring substrate and an electrode.

D. Appendixes

The following configurations are recognized from the foregoing exemplified embodiments.

In a preferred aspect (first aspect), a liquid ejecting apparatus includes a first pressure chamber communicating with a first nozzle for ejecting a liquid, a second pressure chamber adjacent to the first pressure chamber and communicating with a second nozzle for ejecting the liquid, and a first driving element corresponding to the first pressure chamber. The liquid ejecting apparatus executes a detection operation of detecting a fluctuation in the pressure of the liquid within the second pressure chamber that occurred when the first driving element was driven to cause the pressure of the liquid within the first pressure chamber to fluctuate. In the first aspect, the fluctuation, detected by the detection operation, in the pressure within the second pressure chamber can be used to determine whether the defect through which the first pressure chamber communicates with the second pressure chamber exists. Specifically, whether a structural defect exists in the pressure chambers can be determined.

In a specific example (second aspect) of the first aspect, the liquid ejecting apparatus includes a second driving element corresponding to the second pressure chamber. In the detection operation, the second driving element is not driven. In the second aspect, since the detection operation is executed in a state in which the second driving element is not driven to cause the pressure within the second pressure chamber to fluctuate, a fluctuation in the pressure within the second pressure chamber due to a fluctuation in the pressure within the first pressure chamber can be detected with high accuracy. Therefore, whether the defect through which the first pressure chamber communicates with the second pressure chamber exists can be determined with high accuracy.

In a specific example (third aspect) of the first or second aspect, the liquid ejecting apparatus includes a first partition wall partitioning the first pressure chamber and the second pressure chamber and determines whether a defect through which the first pressure chamber communicates with the second pressure chamber exists in the first partition wall based on the fluctuation, detected by the detection operation, in the pressure within the second pressure chamber. In the third aspect, whether the defect through which the first pressure chamber communicates with the second pressure chamber exists can be determined.

In a specific example (fourth aspect) of the third aspect, when an amplitude value of a voltage indicating the fluctuation, detected by the detection operation, in the pressure within the second pressure chamber is equal to or larger than a first threshold, the defect is determined as existing in the first partition wall. In the fourth aspect, when a defect does not exist in the first partition wall, a fluctuation in the pressure within the first pressure chamber does not propagate to the liquid within the second pressure chamber. On the other hand, when the defect exists in the first partition wall, the fluctuation in the pressure within the first pressure chamber propagates to the liquid within the second pressure chamber. Therefore, the fluctuation in the pressure within the second pressure chamber is large, compared to the case in which the defect does not exist in the first partition wall. Specifically, the amplitude value of the voltage indicating the fluctuation in the pressure is large. In consideration of on the foregoing trend, it is possible to determine whether the defect exists in the first partition wall by comparing the first threshold with the amplitude value.

In a specific example (fifth aspect) of the first or second aspect, the liquid ejecting apparatus includes a third pressure chamber adjacent to the second pressure chamber and communicating with a third nozzle for ejecting the liquid, and a third driving element corresponding to the third pressure chamber. The detection operation is executed to detect a fluctuation in the pressure of the liquid within the second pressure chamber that occurred when the first driving element was driven to cause the pressure of the liquid within the first pressure chamber to fluctuate and the third driving element was driven to cause the pressure of the liquid within the third pressure chamber to fluctuate. In the fifth aspect, the fluctuation in the pressure within the second pressure chamber when the first and third driving elements are driven can be used to determine whether a defect through which the first pressure chamber communicates with the second pressure chamber exists and whether a defect through which the second pressure chamber communicates with the third pressure chamber exists.

In a specific example (sixth aspect) of the fifth aspect, the liquid ejecting apparatus includes a first partition wall partitioning the first pressure chamber and the second pressure chamber, and a second partition wall partitioning the second pressure chamber and the third pressure chamber. When an amplitude value of a voltage indicating the fluctuation, detected by the detection operation, in the pressure within the second pressure chamber is equal to or larger than a first threshold, a defect through which the first pressure chamber communicates with the second pressure chamber is determined as existing in the first partition wall, or a defect through which the second pressure chamber communicates with the third pressure chamber is determined as existing in the second partition wall. When the amplitude value of the voltage indicating the fluctuation, detected by the detection operation, in the pressure within the second pressure chamber is equal to or larger than a second threshold larger than the first threshold, the defect through which the first pressure chamber communicates with the second pressure chamber is determined as existing in the first partition wall, and the defect through which the second pressure chamber communicates with the third pressure chamber is determined as existing in the second partition wall. In the sixth aspect, it is possible to determine whether both or any of the defect through which the first pressure chamber communicates with the second pressure chamber and the defect through which the second pressure chamber communicates with the third pressure chamber exist or exists.

In a specific example (seventh example) of the fifth or sixth aspect, the liquid ejecting apparatus includes a fourth pressure chamber adjacent to the third pressure chamber and communicating with a fourth nozzle for ejecting the liquid, a fifth pressure chamber adjacent to the fourth pressure chamber and communicating with a fifth nozzle for ejecting the liquid, a fourth driving element corresponding to the fourth pressure chamber, and a fifth driving element corresponding to the fifth pressure chamber. The detection operation is executed to detect a fluctuation in the pressure of the liquid within the fourth pressure chamber that occurred when the third driving element was driven to cause the pressure of the liquid within the third pressure chamber to fluctuate and the fifth driving element was driven to cause the pressure of the liquid within the fifth pressure chamber to fluctuate. In the detection operation, the fluctuations in the pressure within the first pressure chamber, the third pressure chamber, and the fifth pressure chamber are not detected. In the seventh aspect, whether a defect exists in each of a plurality of partition walls defining the pressure chambers can be determined by detecting a fluctuation in the pressure of the liquid within the second pressure chamber that occurred when the first driving element was driven to cause the pressure of the liquid within the first pressure chamber to fluctuate and the third driving element was driven to cause the pressure of the liquid within the third pressure chamber to fluctuate and detecting the fluctuation in the pressure of the liquid within the fourth pressure chamber that occurred when the third driving element was driven to cause the pressure of the liquid within the third pressure chamber to fluctuate and the fifth driving element was driven to cause the pressure of the liquid within the fifth pressure chamber to fluctuate. Specifically, since every other pressure chamber among the plurality of pressure chambers is inspected, the pressure chambers can be efficiently inspected.

In a specific example (eighth aspect) of any of the first to seventh aspects, the detection operation is executed in a state in which the first nozzle is closed. In the eighth aspect, since meniscus within the first nozzle hardly vibrates, a fluctuation in the pressure within the first pressure chamber easily propagates to the liquid within the second pressure chamber through a defective portion. Therefore, a fluctuation in the pressure within the second pressure chamber due to a fluctuation in the pressure within the first pressure chamber can be detected with high accuracy. Specifically, whether a defect exists in the first partition wall can be determined with high accuracy.

In a specific example (ninth aspect) of the eighth aspect, a micro-vibration waveform for causing the liquid within the first pressure chamber to slightly vibrate without ejecting the liquid from the first nozzle is supplied to the first driving element to increase the viscosity of the liquid within the first nozzle and close the first nozzle by the liquid with the increased viscosity. In the ninth aspect, since the first nozzle is closed by supplying the micro-vibration waveform to the first driving element, the first nozzle can be closed by a simple configuration, compared to, for example, a configuration in which the liquid ejecting apparatus includes a member for closing the first nozzle.

In a specific example (tenth aspect) of the ninth aspect, whether the first nozzle is closed is determined based on a residual vibration within the first pressure chamber that occurred when the first driving element was driven to cause the pressure of the liquid within the first pressure chamber to fluctuate. When the first nozzle is determined as not being closed, the micro-vibration waveform is supplied to the first driving element. In the tenth aspect, when the first nozzle is determined as not being closed, the micro-vibration waveform is supplied to the first driving element, and thus an increase in the viscosity of the liquid within the first nozzle is progressed. It is, therefore, possible to suppress the execution of the detection operation in a state in which the first nozzle is not closed.

In a specific example (eleventh aspect) of the eighth aspect, the liquid ejecting apparatus includes a contact portion that closes the first nozzle when the contact portion is in contact with an ejection surface in which the first nozzle is formed. In the eleventh aspect, the first nozzle can be quickly closed without an increase in the viscosity of the liquid within the first nozzle.

In a specific example (twelfth aspect) of any of the first to eleventh aspects, the detection operation is executed in a state in which the second nozzle is closed. In the twelfth aspect, since meniscus within the second nozzle hardly vibrates, a fluctuation in the pressure within the second pressure chamber hardly attenuates in the second pressure chamber. Therefore, whether a defect exists in the first partition wall can be determined with high accuracy.

In a specific example (thirteenth aspect) of any of the first to twelfth aspects, after the execution of the detection operation, a maintenance operation of discharging the liquid from the first and second nozzles is executed. By discharging the liquid within the first and second nozzles after the execution of the detection operation, an increase in the viscosity of the liquid can be eliminated. Specifically, a state in which the nozzles are closed is canceled.

In a specific example (fourteenth aspect) of any of the first to thirteenth aspects, the first driving element causes the pressure of the liquid within the first pressure chamber to fluctuate when an inspection waveform is supplied to the first driving element. In the detection operation, after the termination of the supply of the inspection waveform to the first driving element, the detection of the fluctuation in the pressure within the second pressure chamber is started. Since the detection of the fluctuation in the pressure within the second pressure chamber is started immediately after the pressure within the first pressure chamber fluctuates, the fluctuation in the pressure within the second pressure chamber due to the fluctuation in the pressure within the first pressure chamber can be detected with high accuracy.

In a specific example (fifteenth aspect) of any of the first to thirteenth aspects, the first driving element causes the pressure of the liquid within the first pressure chamber to fluctuate when an inspection waveform is supplied to the first driving element. In the detection operation, the detection of the fluctuation in the pressure within the second pressure chamber is started at the same time as the start of the supply of the inspection waveform to the first driving element or within a time period for supplying the inspection waveform to the first driving element. In the fifteenth aspect, since the detection of the fluctuation in the pressure within the second pressure chamber is started at the same time as the start of the supply of the inspection waveform to the first driving element or within the time period for supplying the inspection waveform to the first driving element, the fluctuation in the pressure within the second pressure chamber due to the fluctuation in the pressure within the first pressure chamber can be detected with high accuracy.

In a specific example (sixteenth aspect) of the third or sixth aspect, a printing operation of executing printing by ejecting the liquid onto a medium is executable. When the defect is determined as existing, at least one of notification of the defect and inhibition of the printing operation is executed. In a state in which an operational failure exists in the liquid ejecting apparatus, the printing operation can be inhibited.

In a preferred aspect (seventeenth aspect), a method for controlling a liquid ejecting apparatus including a first pressure chamber communicating with a first nozzle for ejecting a liquid, a second pressure chamber adjacent to the first pressure chamber and communicating with a second nozzle for ejecting the liquid, and a first driving element corresponding to the first pressure chamber includes executing a detection operation of detecting a fluctuation in the pressure of the liquid within the second pressure chamber that occurred when the first driving element was driven to cause the pressure of the liquid within the first pressure chamber to fluctuate.

In a specific example (eighteenth aspect) of the seventeenth aspect, the liquid ejecting apparatus includes a second driving element corresponding to the second pressure chamber. In the detection operation, the second driving element is not driven.

In a specific example (nineteenth aspect) of the seventeenth or eighteenth aspect, the detection operation is executed in a state in which the first nozzle is closed.

In a specific example (twentieth aspect) of the nineteenth aspect, a micro-vibration waveform for causing the liquid within the first pressure chamber to slightly vibrate without ejecting the liquid from the first nozzle is supplied to the first driving element to increase the viscosity of the liquid within the first nozzle and close the first nozzle by the liquid with the increased viscosity.

What is claimed is:

1. A liquid ejecting apparatus comprising:

a first pressure chamber communicating with a first nozzle configured to eject a liquid;

a second pressure chamber adjacent to the first pressure chamber and communicating with a second nozzle configured to eject the liquid; and a first driving element corresponding to the first pressure chamber, wherein a detection operation of detecting a fluctuation in the pressure of the liquid within the second pressure chamber that occurred when the first driving element was driven to cause the pressure of the liquid within the first pressure chamber to fluctuate is executed, wherein the detection operation is executed in a state in which the first nozzle is closed.

2. The liquid ejecting apparatus according to claim 1, further comprising:

a second driving element corresponding to the second pressure chamber, wherein the second driving element is not driven in the detection operation.

3. The liquid ejecting apparatus according to claim 1, further comprising:

a first partition wall partitioning the first pressure chamber and the second pressure chamber, wherein whether a defect through which liquid flows between the first pressure chamber and the second pressure chamber exists in the first partition wall is determined based on the fluctuation, detected by the detection operation, in the pressure within the second pressure chamber.

4. The liquid ejecting apparatus according to claim 3, wherein when an amplitude value of a voltage indicating the fluctuation, detected by the detection operation, in the pressure within the second pressure chamber is equal to or larger than a first threshold, the defect is determined as existing in the first partition wall.

5. The liquid ejecting apparatus according to claim 1, further comprising:

a third pressure chamber adjacent to the second pressure chamber and communicating with a third nozzle configured to eject the liquid; and a third driving element corresponding to the third pressure chamber, wherein the detection operation is executed to detect a fluctuation in the pressure of the liquid within the second pressure chamber that occurred when the first driving element was driven to cause the pressure of the liquid within the first pressure chamber to fluctuate and the third driving element was driven to cause the pressure of the liquid within the third pressure chamber to fluctuate.

6. The liquid ejecting apparatus according to claim 5, further comprising:

a first partition wall partitioning the first pressure chamber and the second pressure chamber; and a second partition wall partitioning the second pressure chamber and the third pressure chamber, wherein when an amplitude value of a voltage indicating the fluctuation, detected by the detection operation, in the pressure within the second pressure chamber is equal to or larger than a first threshold, a defect through which the first pressure chamber communicates with the second pressure chamber is determined as existing in the first partition wall or a detect through which the second pressure chamber communicates with the third pressure chamber is determined as existing in the second partition wall, and when the amplitude value of the voltage indicating the fluctuation, detected by the detection operation, in the pressure within the second pressure chamber is equal to or larger than a second threshold larger than the first threshold, the defect through which the first pressure chamber communicates with the second pressure chamber is determined as existing in the first partition wall and the defect through which the second pressure chamber communicates with the third pressure chamber is determined as existing in the second partition wall.

7. The liquid ejecting apparatus according to claim 5, further comprising:

a fourth pressure chamber adjacent to the third pressure chamber and communicating with a fourth nozzle configured to eject the liquid;

a fifth pressure chamber adjacent to the fourth pressure chamber and communicating with a fifth nozzle configured to eject the liquid;

a fourth driving element corresponding to the fourth pressure chamber; and a fifth driving element corresponding to the fifth pressure chamber, wherein the detection operation is executed to detect a fluctuation in the pressure of the liquid within the fourth pressure chamber that occurred when the third driving element was driven to cause the pressure of the liquid within the third pressure chamber to fluctuate and the fifth driving element was driven to cause the pressure of the liquid within the fifth pressure chamber to fluctuate, and in the detection operation, fluctuations in the pressure within the first pressure chamber, the third pressure chamber, and the fifth pressure chamber are not detected.

8. The liquid ejecting apparatus according to claim 1, wherein a micro-vibration waveform for causing the liquid within the first pressure chamber to slightly vibrate without ejecting the liquid from the first nozzle is supplied to the first driving element to increase the viscosity of the liquid within the first nozzle and close the first nozzle by the liquid with the increased viscosity.

9. The liquid ejecting apparatus according to claim 8, wherein whether the first nozzle is closed is determined based on a residual vibration within the first pressure chamber that occurred when the first driving element was driven to cause the pressure of the liquid within the first pressure chamber to fluctuate, and when the first nozzle is determined as not being closed, the micro-vibration waveform is supplied to the first driving element.

10. The liquid ejecting apparatus according to claim 1, further comprising:

an ejecting surface including the first nozzle; and a contact portion configured to close the first nozzle when the contact portion is in contact with the ejection surface.

11. The liquid ejecting apparatus according to claim 1, wherein the detection operation is executed in a state in which the second nozzle is closed.

12. The liquid ejecting apparatus according to claim 1, wherein after the execution of the detection operation, a maintenance operation of discharging the liquid from the first nozzle and the second nozzle is executed.

13. The liquid ejecting apparatus according to claim 1, wherein the first driving element causes the pressure of the liquid within the first pressure chamber to fluctuate when an inspection waveform is supplied to the first driving element, and in the detection operation, after the termination of the supply of the inspection waveform to the first driving element, the detection of the fluctuation in the pressure within the second pressure chamber is started.

14. The liquid ejecting apparatus according to claim 1, wherein the first driving element causes the pressure of the liquid within the first pressure chamber to fluctuate when an inspection waveform is supplied to the first driving element, and in the detection operation, the detection of the fluctuation in the pressure within the second pressure chamber is started at the same time as the start of the supply of the inspection waveform to the first driving element or within a time period for supplying the inspection waveform to the first driving element.

15. The liquid ejecting apparatus according to claim 3, wherein when the defect is determined as existing, at least one of notification of the defect and inhibition of a printing operation of executing printing by ejecting the liquid onto a medium is executed.

16. A liquid ejecting apparatus comprising:

a first pressure chamber communicating with a first nozzle configured to eject a liquid;

a second pressure chamber adjacent to the first pressure chamber and communicating with a second nozzle configured to eject the liquid; and a first driving element corresponding to the first pressure chamber, wherein a detection operation of detecting a fluctuation in the pressure of the liquid within the second pressure chamber that occurred when the first driving element was driven to cause the pressure of the liquid within the first pressure chamber to fluctuate is executed, wherein the detection operation is executed in a state in which the second nozzle is closed.

17. A liquid ejecting apparatus comprising:

a first pressure chamber communicating with a first nozzle configured to eject a liquid;

a second pressure chamber adjacent to the first pressure chamber and communicating with a second nozzle configured to eject the liquid;

a first partition wall partitioning the first pressure chamber and the second pressure chamber; and a first driving element corresponding to the first pressure chamber, wherein a detection operation of detecting a fluctuation in the pressure of the liquid within the second pressure chamber that occurred when the first driving element was driven to cause the pressure of the liquid within the first pressure chamber to fluctuate is executed, and whether a defect through which liquid flows between the first pressure chamber and the second pressure chamber exists in the first partition wall is determined based on the fluctuation, detected by the detection operation, in the pressure within the second pressure chamber.

* * * * *